US007641061B1

(12) United States Patent
Cuzzocrea

(10) Patent No.: US 7,641,061 B1
(45) Date of Patent: Jan. 5, 2010

(54) RETAIL HANGER DISPLAY SYSTEM

(76) Inventor: Lawrence A. Cuzzocrea, 3502 E. Vineyard Rd., Phoenix, AZ (US) 85040

( * ) Notice: Subject to any disclaimer, the term of this patent is extended or adjusted under 35 U.S.C. 154(b) by 651 days.

(21) Appl. No.: 11/379,209

(22) Filed: Apr. 18, 2006

Related U.S. Application Data

(63) Continuation-in-part of application No. 10/455,003, filed on Jun. 3, 2003, now abandoned, and a continuation-in-part of application No. 10/377,490, filed on Feb. 27, 2003, now abandoned, which is a continuation-in-part of application No. 09/641,001, filed on Aug. 17, 2000, now abandoned.

(60) Provisional application No. 60/360,339, filed on Feb. 27, 2002.

(51) Int. Cl.
*A47F 5/08* (2006.01)

(52) U.S. Cl. ..... 211/113

(58) Field of Classification Search ..... 211/113, 211/115–119, 57.1, 190, 59.1, 87.01, 103, 211/207; 248/304, 317, 327, 339, 227.3, 248/207, 228.6, 220.31, 220.43; 40/642.01, 40/666, 607.12, 611.12
See application file for complete search history.

(56) References Cited

U.S. PATENT DOCUMENTS 1,651,126 A * 11/1927 Ingalls ..... 359/552
2,113,180 A * 4/1938 Klein ..... 40/607.12
2,262,873 A * 11/1941 Wise ..... 40/607.12
2,626,713 A * 1/1953 Peacock ..... 211/89.01
2,893,147 A * 7/1959 Mollet, III ..... 40/604
3,420,383 A * 1/1969 Raynor ..... 211/113
3,967,346 A * 7/1976 Young, Jr. ..... 211/89.01
4,093,168 A * 6/1978 Buril ..... 248/220.41
4,270,721 A * 6/1981 Mainor, Jr. ..... 248/285.1
4,387,873 A * 6/1983 Pavlo et al. ..... 248/227.1
4,573,590 A * 3/1986 Ellis ..... 211/85.15
5,020,677 A * 6/1991 Wirth et al. ..... 211/113
5,076,446 A * 12/1991 Simmerman et al. ..... 211/113
5,088,606 A * 2/1992 Boas ..... 211/57.1
5,147,050 A * 9/1992 Cullen ..... 211/118
5,346,166 A * 9/1994 Valiulis ..... 248/220.41
5,375,803 A * 12/1994 Kump ..... 248/231.81
5,388,709 A * 2/1995 Adams ..... 211/70.6
5,428,913 A * 7/1995 Hillstrom ..... 40/604
5,683,003 A * 11/1997 Gebka ..... 211/57.1
5,908,119 A * 6/1999 Kump et al. ..... 211/113
5,957,422 A * 9/1999 Shea ..... 248/220.31
6,006,929 A * 12/1999 Leonard ..... 211/113
RE36,669 E * 4/2000 Zilincar, III ..... 211/86.01

(Continued)

*Primary Examiner*—Jennifer E. Novosad
(74) *Attorney, Agent, or Firm*—Stoneman Volk Patent Group; Martin L. Stoneman; Michael D. Volk, Jr.

(57) ABSTRACT

A retail display system for increasing density of merchandising of products, by using the otherwise unused space of existing display configurations. A hanger display configuration, which may hold vertical strip displays, is installed in such a manner as to adapt to a diverse range of product packaging and shelving fixture types, efficiently provide signage, pricing and scanning information, and to reduce theft. The hanger display configuration can be manufactured for a specific product and specific quantity of such product. Faceplates have clamps on the rear face for clamping the faceplates to seldom-used non-shelve portions of the rack display and other store fixtures, such as bars, stanchions, corners, etc.

22 Claims, 13 Drawing Sheets

U.S. PATENT DOCUMENTS

D431,078 S * 9/2000 Lorenzo et al. ..... D24/128
6,186,454 B1 * 2/2001 Olsen ..... 248/218.4
6,234,330 B1 * 5/2001 Gray ..... 211/106
6,286,690 B1 * 9/2001 Thalenfeld ..... 211/113
6,340,091 B1 * 1/2002 Romeo et al. ..... 211/59.2
6,412,204 B1 * 7/2002 Shoemaker et al. ..... 40/606.15
6,581,789 B1 * 6/2003 Spanski et al. ..... 211/106
6,951,290 B2 * 10/2005 Speed ..... 211/113
7,100,878 B2 * 9/2006 Shea ..... 248/220.31
2003/0178384 A1 * 9/2003 Speed ..... 211/119.003

* cited by examiner

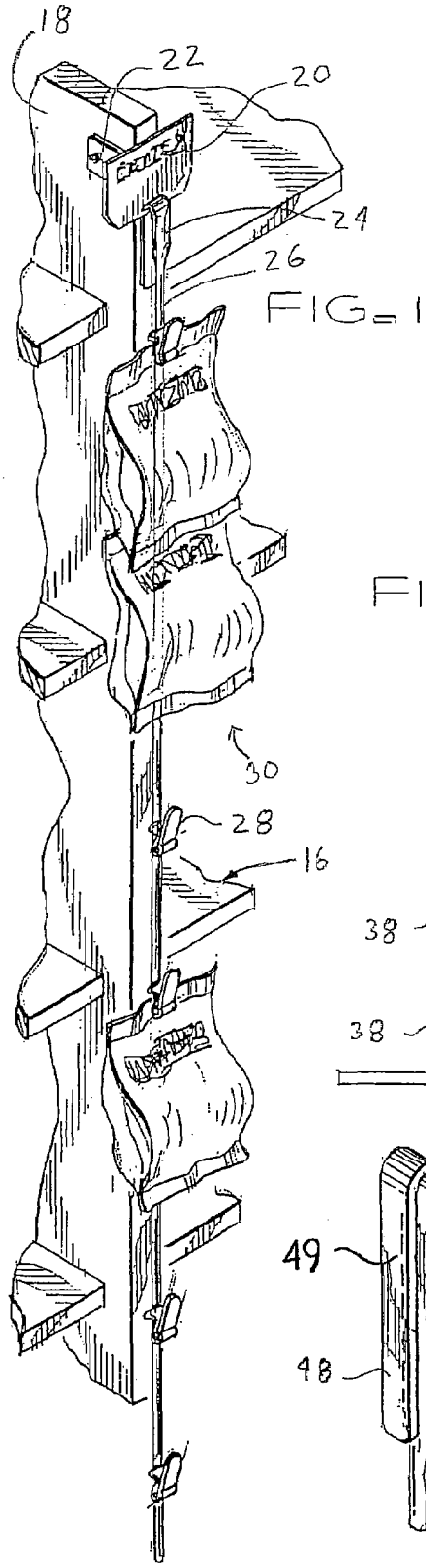
FIG. 1
FIG. 2
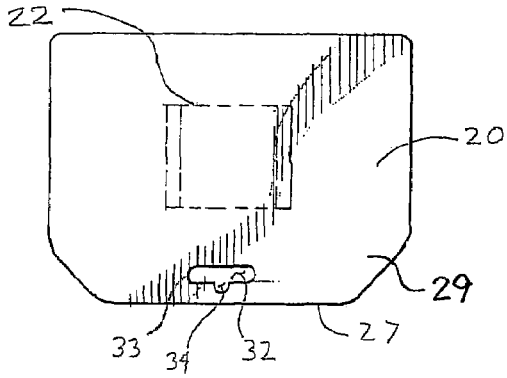
FIG. 3
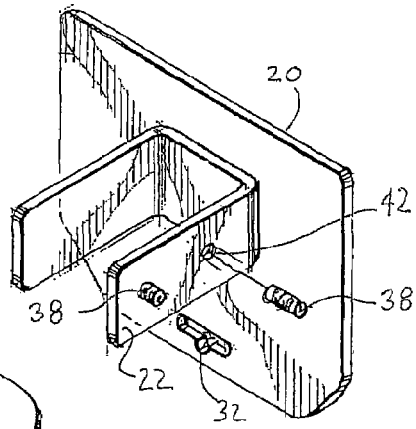
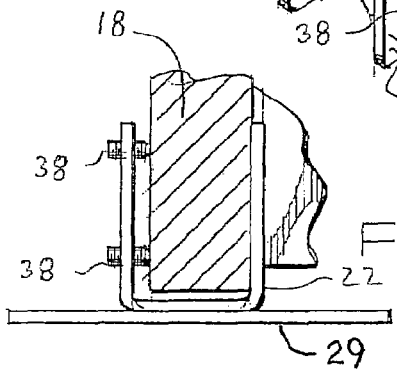
FIG. 4
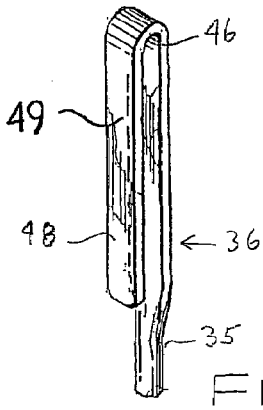
FIG. 6
FIG. 5
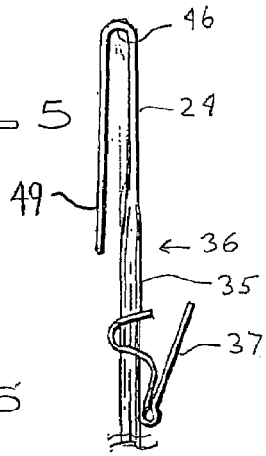

FIG. 7
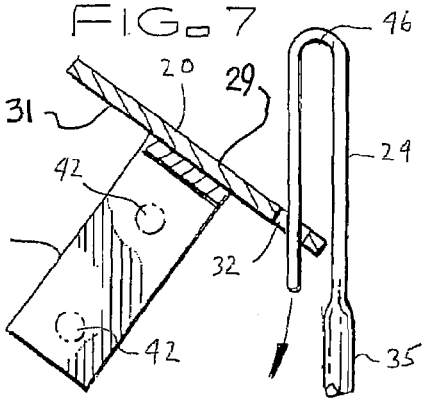
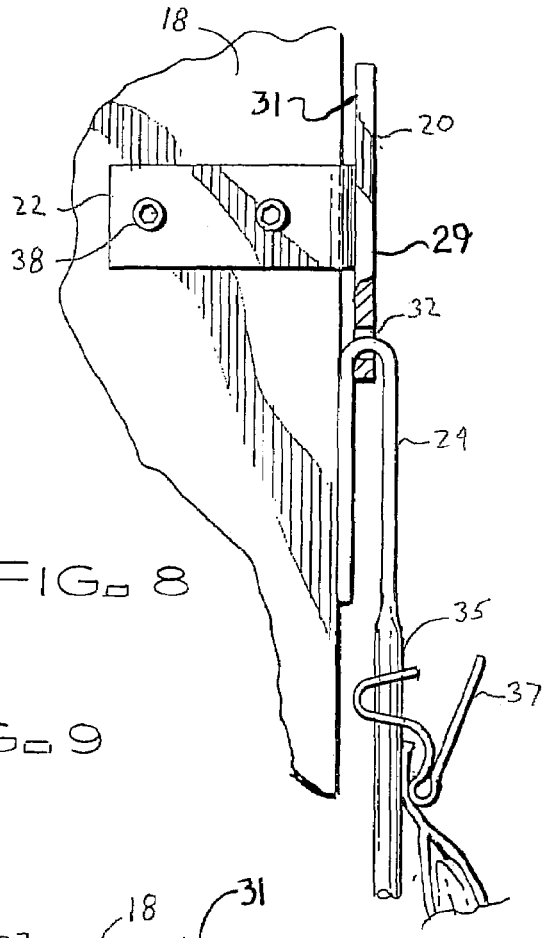
FIG. 8
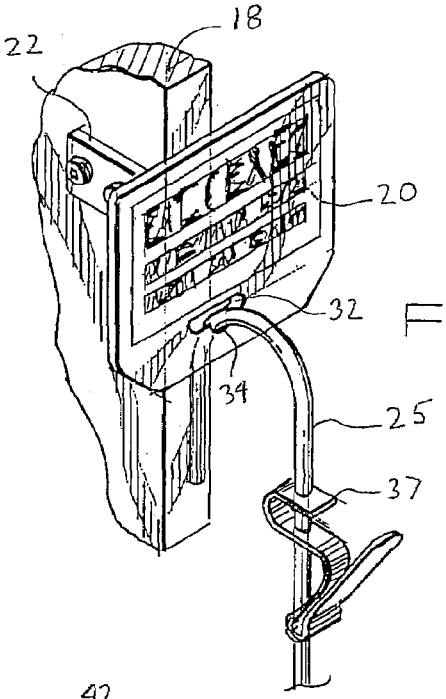
FIG. 9
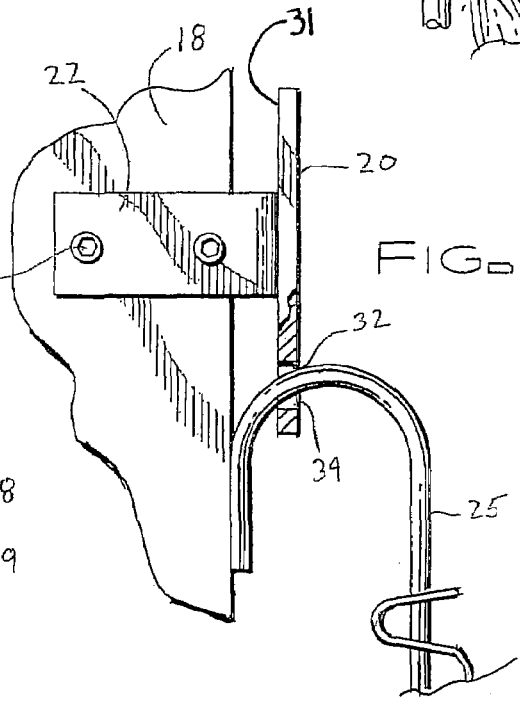
FIG. 10
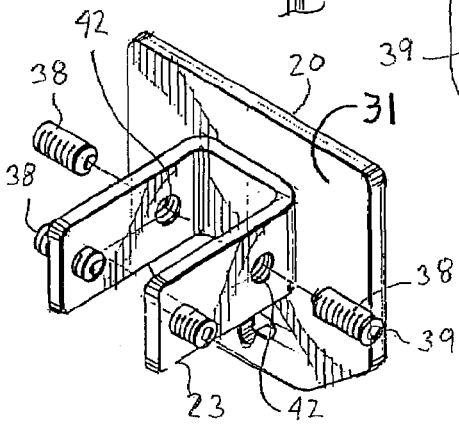
FIG. 12

FIG. 17
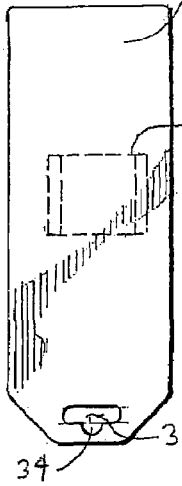
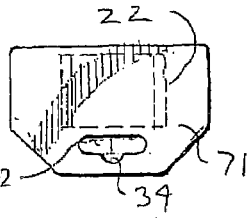
FIG. 18
FIG. 19
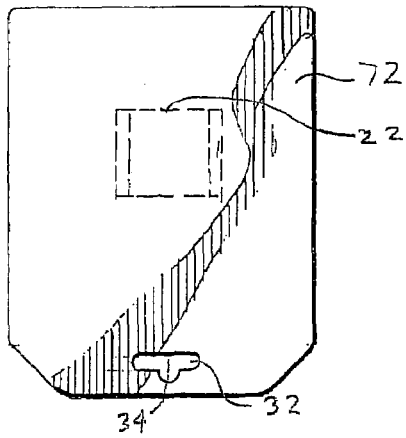
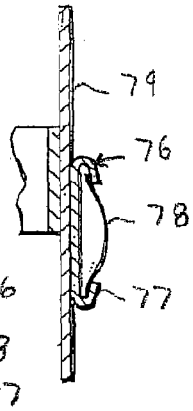
FIG. 21
FIG. 22
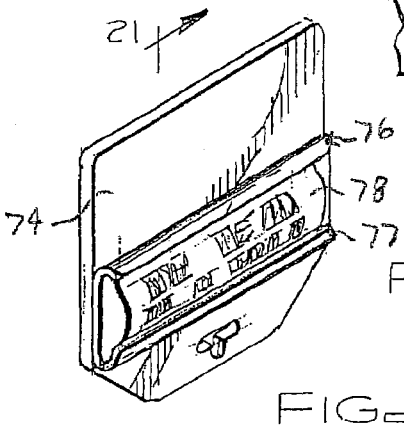
FIG. 20
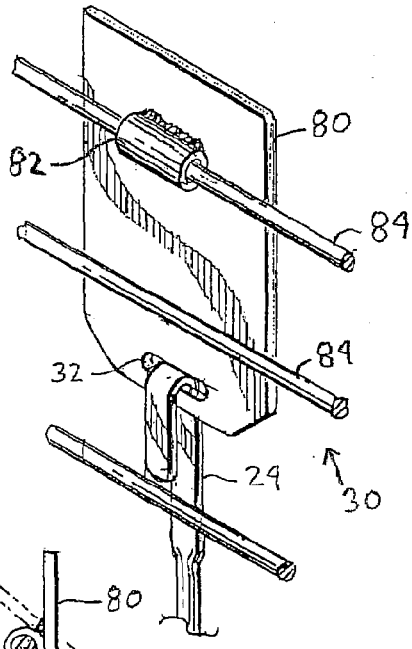
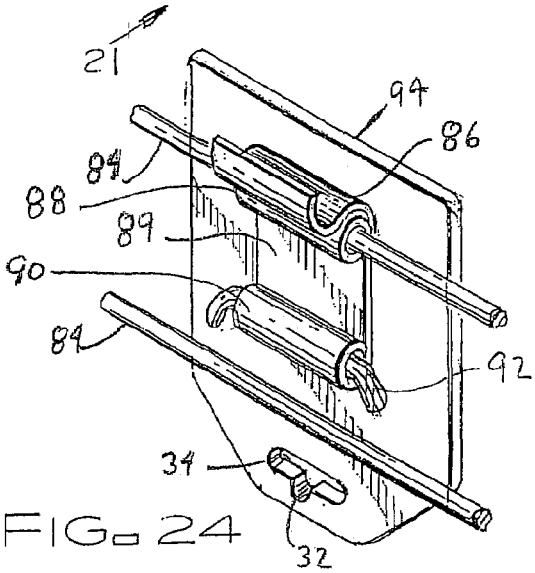
FIG. 24
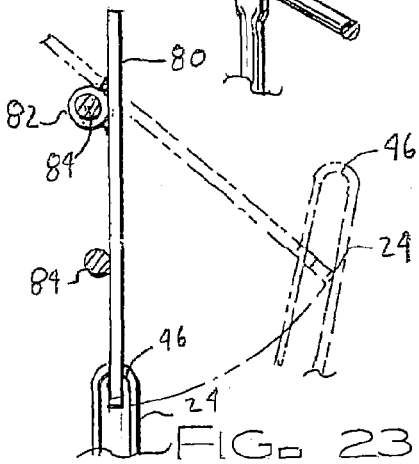
FIG. 23

FIG. 25
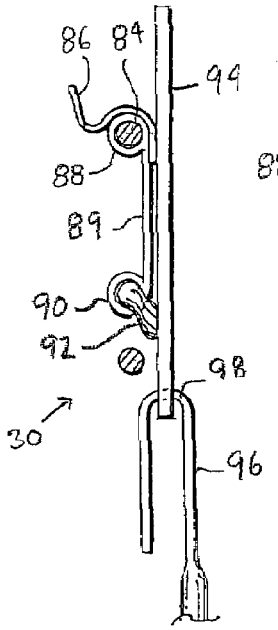
FIG. 26
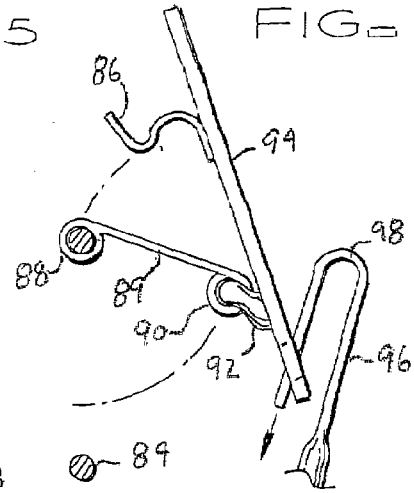
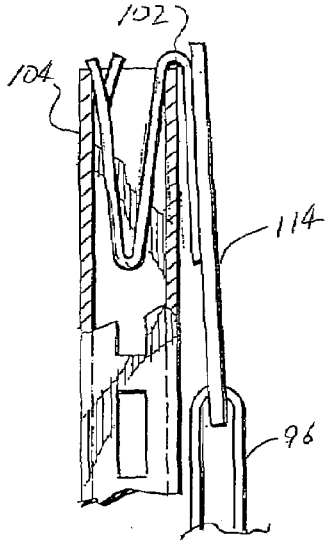
FIG. 28
FIG. 27
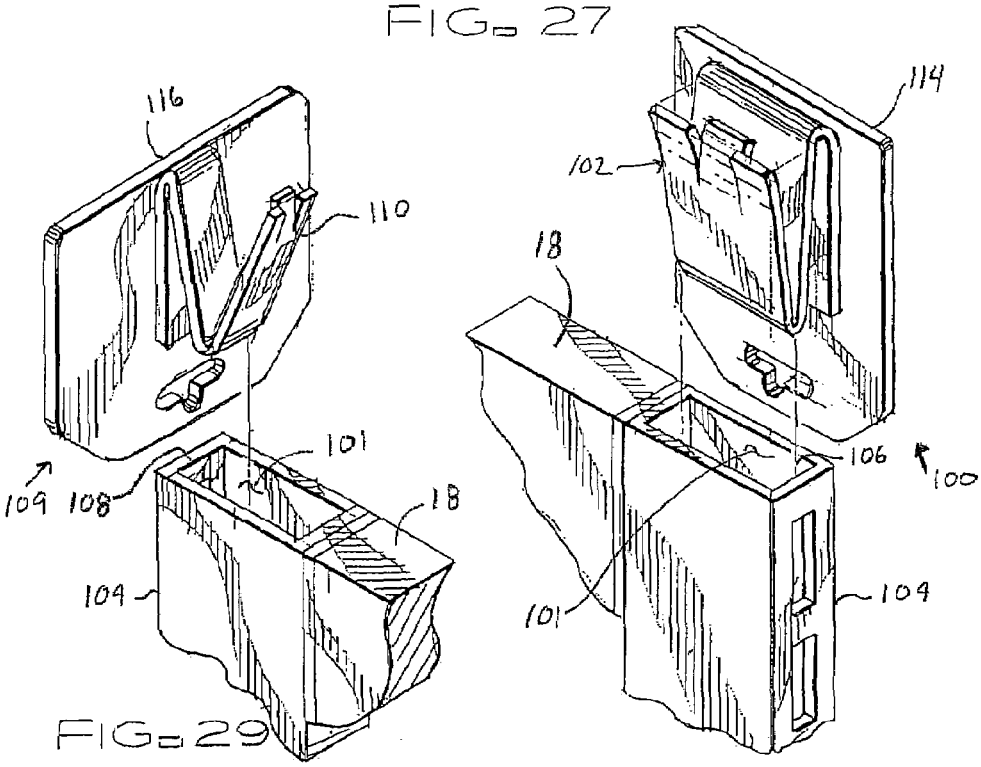
FIG. 29

FIG. 30
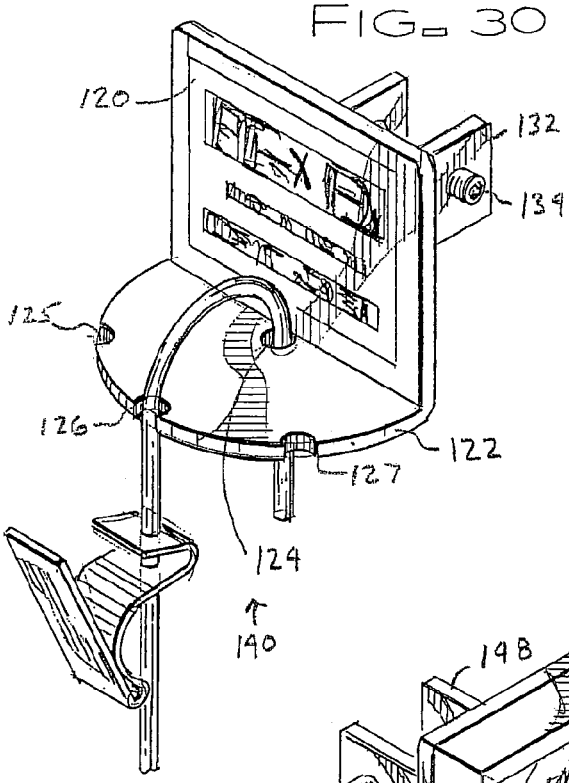
FIG. 31
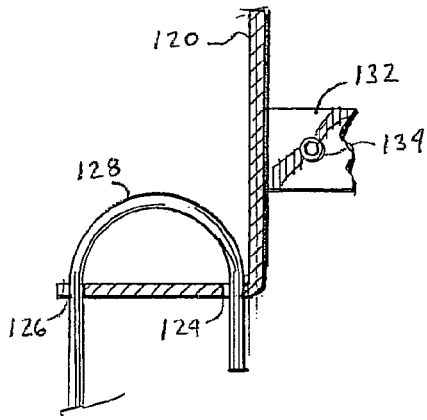
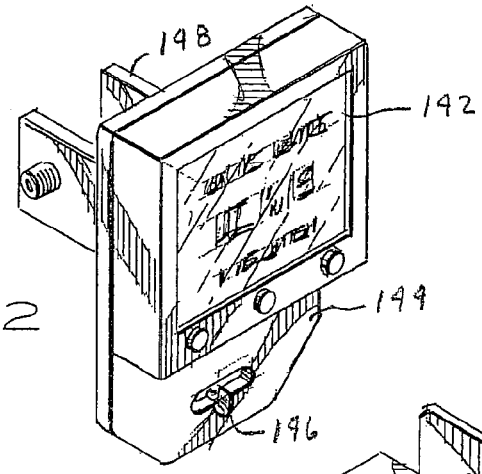
FIG. 32
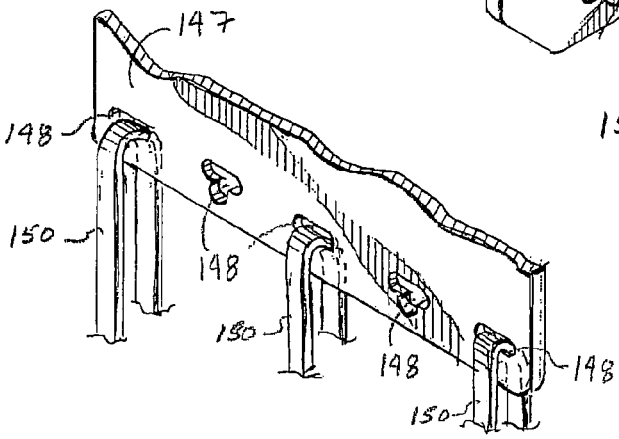
FIG. 33
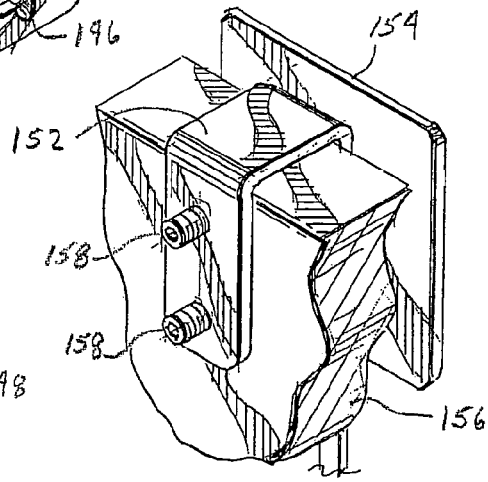
FIG. 34

FIG. 41
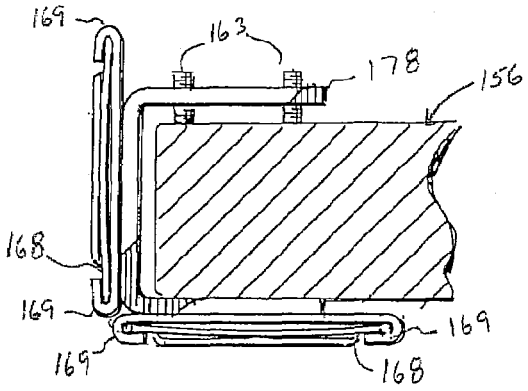
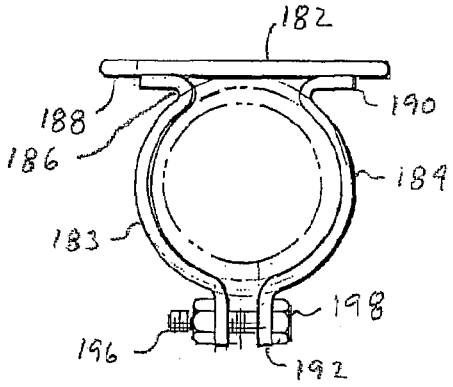
FIG. 43
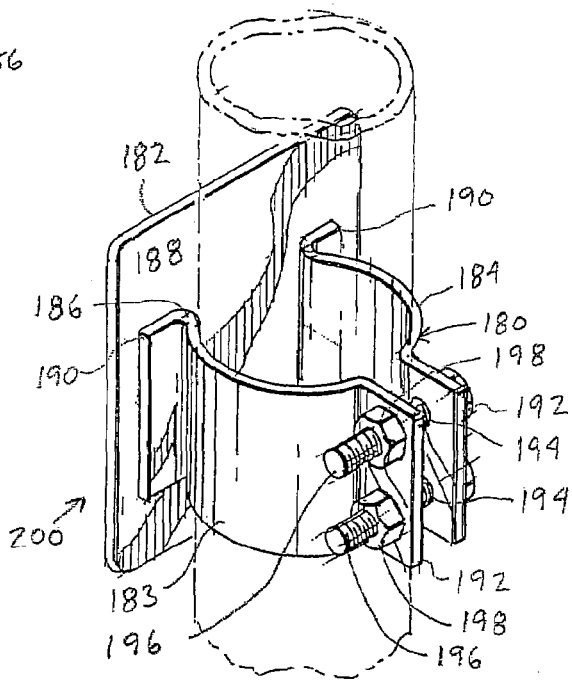
FIG. 42
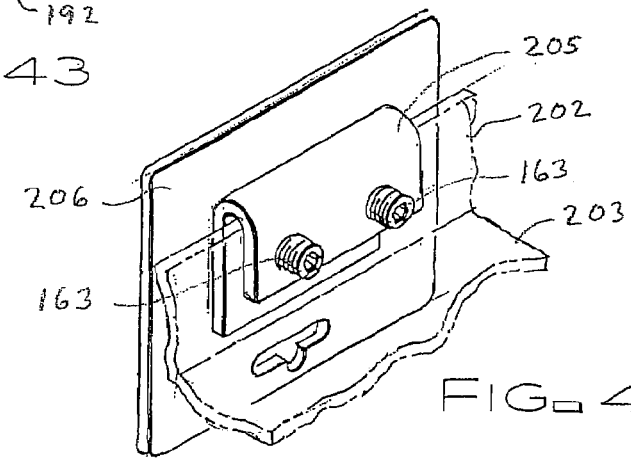
FIG. 44
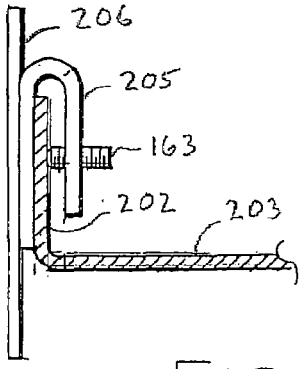
FIG. 45

RETAIL HANGER DISPLAY SYSTEM

REFERENCES TO RELATED APPLICATIONS

The present application is a continuation-in-part of my related U.S. utility patent application Ser. No. 10/455,003, filed Jun. 3, 2003, entitled "RETAIL HANGER DISPLAY SYSTEM", (which is a continuation-in-part of my related U.S. utility patent application Ser. No. 09/641,001, filed Aug. 17, 2000, entitled "RETAIL DISPLAY SYSTEM", and is also a continuation-in-part of my related U.S. utility patent application Ser. No. 10/377,490, filed Feb. 27, 2003, entitled "RETAIL HANGER DISPLAY SYSTEM" (which claims priority to my related U.S. provisional patent application Ser. No. 60/360,339, filed Feb. 27, 2002, entitled "RETAIL HANGER DISPLAY SYSTEM))." These related applications are incorporated herein by this reference and are not admitted to be prior art with respect to the present invention by the mention in this cross-reference section.

BACKGROUND OF THE INVENTION

This invention relates to providing an improved system for displaying and marketing merchandise, including more efficient use of space and better inventory control. More particularly, this invention concerns a highly adaptable retail display system that efficiently uses normally unused space within a store to display and sell merchandise. The field of product display and marketing has increasingly become a more exact science involving extensive research into the shopping and purchasing behaviors of consumers. As a result, retailers have become increasingly sophisticated in their application of product-display systems.

Typically, a retail space will include a diverse range of product-display fixtures. Arrangement of such fixtures often follows a set of tactics for ensuring that a maximum number of shoppers will see and actively consider purchasing a displayed product. It is well-known that specific prime locations within a retail floor space are highly desirable for generation of sales. Similarly, prime locations within, and on, display-fixtures are known to produce higher sales volume. A principal need of many retailers is to maximize the quantity of products displayed within a given floor area, and more specifically, to maximize the display of products with the highest sales volumes, cash values and profit margins within the prime store locations. In addition, distributors often pay additional bonuses or rewards to stores that choose to assign a highly desired space to display their particular product line. For these and other reasons, it is economically important to most retailers to utilize the maximum amount of available product display space within a store.

Furthermore, many product vendors require flexibility in displaying their product and controlling their inventory within the product display system. Currently, a large number of retailers rely on cumbersome, industry standard, retail display systems that allow only limited flexibility in arrangement, ease of modification and product-specific display. Many retailers utilize the theory that the best solution for some product lines is to create relatively static, permanent displays; however, not all products merit such long-term placement. Many products are not always in large demand or are seasonal. For example, promotional products tied to a seasonal holiday or new movie release may have a relatively short (yet highly lucrative) promotional window. It is highly desirable that product placement systems that are easy to modify and provide a high degree of adaptability (quickly adaptable to new marketing strategies and inventory management solutions) would be extremely desirable for use in the retail industry.

Currently, many retailers use a variety of add-on merchandising displays in conjunction with existing conventional shelving construction to increase product display densities. These methods include utilizing vertically hanging strip-displays that have a vertical row of hooks or clips for holding packages of merchandise. While this type of typical strip-type-merchandising-system is effective for the display of certain products, they suffer from distinct shortcomings. For example, strip-type merchandising systems are typically made of flimsy construction that may be easily dislodged or removed from its supports. Further, such strip-type merchandising systems are limited in their adaptability to a diverse range of packaging, product lines, display quantities and shelving types. Further, most strip-type merchandising systems provide limited opportunities for supplementary advertising and product branding (the display of a specific or well-established brand name of merchandise). As previously mentioned, such strip-type merchandising systems are typically not securely affixed to store fixtures and may even be stolen or removed easily by unauthorized persons.

Merchandisers, marketers, and advertisers are increasingly seeking to attract buyers by rapidly revising product packaging, as well as marketing strategies. These revisions require the retailer to find flexibility and adaptability within their own product display systems.

OBJECTS OF THE INVENTION

A primary object and feature of the present invention is to fulfill the above-mentioned needs by the provision of a vertical strip display system that displays merchandise for sale using assorted non-shelf portions, space otherwise unused, of existing display fixtures.

In addition, it is a primary object and feature that the display system is installed in such a manner as to deter theft of such strip displays.

Additionally, it is a primary object and feature of this invention to provide a strip display system that is adaptable to a diverse range of product packaging and shelving fixture types.

It is a further primary object and feature of this invention to efficiently provide signage, pricing and scanning information.

It is a further object and feature of the present invention to provide such a display feature that is manufactured for a specific product and specific quantity of such product.

It is a further object and feature of the present invention to provide such a display feature that is designed to reduce the risk of injury due to contact with its parts.

A further object and feature of the present invention is to provide such a display system that is efficient, inexpensive and handy. Other objects of this invention will become apparent with reference to the following descriptions.

SUMMARY OF THE INVENTION

In accordance with a preferred embodiment hereof, this invention provides a merchandise display system comprising: at least one support plate comprising at least one front face, at least one rear face, and at least one aperture, wherein such at least one rear face comprises at least one attacher; at least one merchandise display hanger comprising at least one hook structured and arranged to removably engage such at least one aperture; at least one merchandise support member structured and arranged to support merchandise; wherein such at least one hook and such at least one aperture are structured and arranged so that such at least one merchandise display hanger can be removably attached to such at least one support plate by inserting such at least one hook into such at least one aperture; wherein such at least one hook and such at least one aperture are structured and arranged so that such at least one hook can be removably inserted into such at least one aperture when such at least one merchandise display hanger and such at least one support plate are in a first relative angular position; wherein such at least one hook and such at least one aperture are structured and arranged so that such at least one hook cannot be removed from such at least one aperture when such at least one merchandise display hanger and such at least one support plate are rotated into a second relative angular position. Moreover, it provides such a merchandise display system wherein such at least one attacher, such at least one hook, and such at least one aperture are structured and arranged so that attaching such at least one attacher prevents removal of such at least one hook from such at least one aperture. Additionally, it provides such a merchandise display system wherein such at least one attacher, such at least one hook, and such at least one aperture are structured and arranged so that attaching such at least one attacher restricts the relative angular position of such at least one merchandise display hanger and such at least one support plate so that such at least one hook cannot be removed from such at least one aperture.

Also, it provides such a merchandise display system wherein such at least at least one support plate and such at least one merchandise display hanger are structured and arranged so that attaching such at least one support plate adjacent a substantially flat surface restricts rotation of such at least one hook so that such at least one hook cannot be removed from such at least one aperture. In addition, it provides such a merchandise display system wherein such at least one front face is structured and arranged to display merchandising indicia. And, it provides such a merchandise display system wherein such at least one attacher comprises at least one clamp. Further, it provides such a merchandise display system wherein such at least one attacher comprises at least one set screw. Even further, it provides such a merchandise display system wherein such at least one merchandise display hanger comprises at least one merchandise display rack. Moreover, it provides such a merchandise display system wherein such at least one merchandise display hanger comprises a plurality of merchandise display clips and/or a plurality of merchandise display pegs. Additionally, it provides such a merchandise display system wherein such at least one merchandise display hanger comprises a plurality of merchandise display holders; wherein at least one of such plurality of merchandise display holders comprises, at least one holder bottom support structured and arranged to support merchandise, at least one holder side rail.

In addition, it provides such a system wherein such at least one hook comprises at least one substantially u-shaped bend. In addition, it provides such a system wherein such at least one hook comprises at least one substantially u-shaped bend with at least one bend radius of less than one-half inch. And, it provides such a system wherein such at least one hook comprises at least one substantially u-shaped bend with a bend radius of substantially one-eighth inch. Further, it provides such a system wherein such at least one hook comprises: at least one first substantially linear segment comprising at least one first segment length; and at least one second substantially linear segment comprising at least one second segment length; wherein such at least one first substantially linear segment and such at least one second substantially linear segment are connected by at least one bend so that such at least one first substantially linear segment and such at least one second substantially linear segment are substantially parallel and offset from each other.

Even further, it provides such a retail display system wherein such at least one merchandise display hanger comprises at least one vertical wire grid. Moreover, it provides such a system wherein such at least one attacher, such at least one hook, and such at least one aperture are structured and arranged so that attaching such at least one attacher restricts the relative angular position of such at least one merchandise display hanger and such at least one support plate so that such at least one hook cannot be removed from such at least one aperture; wherein such at least one front face is structured and arranged to display merchandising indicia; wherein such at least one attacher comprises at least one set screw; wherein such at least one merchandise display hanger comprises a plurality of merchandise display holders; wherein at least one of such plurality of merchandise display holders comprises, at least one holder bottom plate structured and arranged to support merchandise, and at least one holder side rail; wherein such at least one hook comprises at least one substantially u-shaped bend.

Additionally, it provides such a system wherein such aperture comprises at least one elongated slot. Also, it provides such a system wherein such at least one hook comprises at least one bar, comprising at least one width, and at least one thickness. wherein such at least one width is substantially greater than such at least one thickness. In addition, it provides such a system wherein such at least one hook and such at least one elongated slot are structured and arranged so that such at least one hook closely fits within such at least one elongated slot to restrict rotation of such at least one merchandise display hanger about at least one axis oriented substantially perpendicular to such at least one front face.

In accordance with another preferred embodiment hereof, this invention provides a method related to display of merchandise, comprising the steps of: providing at least one support plate comprising at least one front face, at least one rear face with at least one attacher, at least one aperture; and providing at least one merchandise display hanger comprising at least one hook structured and arranged to removably engage such at least one aperture; at least one merchandise support member structured and arranged to support merchandise; supporting such at least one hook from such at least one support plate by engagement of such at least one hook within such at least one aperture; positioning such at least one support plate adjacent to at least one surface; and attaching such at least one support plate adjacent to such at least one surface to prevent disengagement of such at least one hook from such at least one aperture by the proximal adjacency of such at least one support plate and such at least one hook to the at least one surface. And, it provides such a method further comprising the step of: providing a plurality of such at least one merchandise support members wherein each such plurality of such at least one merchandise support members are adapted to hold at least one specified kind of supplementary merchandise; and wherein each of such plurality of such at least one merchandise support members are further adapted to hold at least one specified quantity of such specified kind of supplementary merchandise. Further, it provides such a method further comprising the step of: supporting a plurality of foodstuffs with such at least one merchandise display hanger.

In accordance with another preferred embodiment hereof, this invention provides a retail display system, comprising: a unitary display holder having at least one front face suitable to display retail sales indicia and having at least one rear face; wherein such unitary display holder comprises on such at least one rear face, at least one clamp structured and arranged to clamp such unitary display holder onto a portion of a store fixture which is not a horizontal shelf, and at least one connector structured and arranged to assist removable attachment of at least one vertical display to such unitary display holder. In accordance with another preferred embodiment hereof, this invention provides a retail display system for increasing density of merchandising of products held by vertical strip displays, comprising: unitary display means having at least one front face for displaying retail sales indicia and having at least one rear face; and wherein such at least one rear face unitary display means comprises on said rear face, clamping means for clamping such unitary display means on a portion of at least one store fixture which is not a horizontal shelf, and attachment means for removably attaching the vertical strip display.

Moreover, it provides such a retail display system wherein such clamping means comprises connection means for clamping such display means onto a vertical store fixture portion having a substantially fixed cross-section from a top of the portion to a bottom of the portion. Additionally, it provides such a retail display system further comprising: security means for preventing removal of the vertical strip display when such unitary display means is clamped such that such attachment means is closely adjacent the portion of the store fixture. Also, it provides such a retail display system wherein: such attachment means comprises slot means for receiving at least one flat hook.

In addition, it provides such a retail display system further comprising: a unitary vertical strip display having at least one upper end; wherein such at least one upper end comprises at least one flat hook. And, it provides such a retail display system wherein: such at least one flat hook comprises an approximately 180-degree bend having a radius of less than one-half inch. Further, it provides such a retail display system wherein: such at least one flat hook comprises an approximately 180-degree bend having a radius of about one-eighth inch.

In accordance with another preferred embodiment hereof, this invention provides a retail display system for increasing density of merchandising of products held by vertical displays, comprising: a unitary display holder having at least one front face suitable to display retail sales indicia and having at least one rear face; wherein such unitary display holder comprises on such at least one rear face, at least one clamp structured and arranged to clamp such unitary display holder onto a portion of a store fixture which is not a horizontal shelf, and at least one connector structured and arranged to assist removable attachment of at least one vertical display to such unitary display holder.

Even further, it provides such a retail display system wherein such at least one clamp is structured and arranged to clamp such unitary display holder onto at least one vertical store fixture portion having a substantially fixed cross-section from a top of the portion to a bottom of the portion. Moreover, it provides such a retail display system wherein: such at least one connector is structured and arranged to prevent removal of the vertical display when such unitary display holder is clamped such that such at least one connector is closely adjacent to the portion of the store fixture.

Additionally, it provides such a retail display system wherein: such at least one connector comprises at least one slot for receiving at least one flat hook. Also, it provides such a retail display system further comprising: a unitary vertical strip display having at least one upper end; wherein such at least one upper end comprises at least one flat hook. In addition, it provides such a retail display system wherein such at least one flat hook comprises an approximately 180-degree bend having a radius of less than one-half inch. And, it provides such a retail display system wherein such at least one flat hook comprises an approximately 180-degree bend having a radius of about one-eighth inch.

Further, it provides such a retail display system wherein: such the unitary vertical store fixture portion comprises a slab. Even further, it provides such a retail display system wherein such at least one clamp comprises Allen-wrench-operable set screws. Moreover, it provides such a retail display system wherein said unitary vertical store fixture portion comprises at least one bar. Additionally, it provides such a retail display system wherein such at least one the bar comprises at least one gondola stanchion. Also, it provides such a retail display system wherein the portion of said the unitary vertical store fixture comprises a portion of at least one vertical wire grid.

In addition, it provides such a retail display system wherein such at least one front face comprises an essentially flat surface. And, it provides such a retail display system wherein such at least one front face comprises at least one vertical groove structured and arranged to removably hold at least one display label. Further, it provides such a retail display system wherein such at least one front face further comprises at least one horizontal groove structured and arranged to removably hold at least one display label. Even further, it provides such a retail display system wherein such at least one front face further comprises at least one horizontal groove structured and arranged to removably hold at least one display label. Moreover, it provides such a retail display system wherein such at least one connector comprises at least one slot. Additionally, it provides such a retail display system wherein such at least one connector comprises at least one round hole. Also, it provides such a retail display system wherein such at least one connector comprises at least one round hole.

In accordance with another preferred embodiment hereof, this invention provides a retail display system for increasing density of merchandising of products held by vertical strip displays, comprising: a unitary vertical strip display having at least one upper end, wherein such at least one upper end comprises at least one flat hook constructed and arranged to hook into at last one flat slot; wherein such at least one flat hook comprises an approximately 180-degree bend having a radius of less than one-half inch.

In addition, it provides such a retail display system further comprising: a unitary display holder having at least one front face suitable to display retail sales indicia and having at least one rear face; wherein such unitary display holder comprises on such at least one rear face, at least one clamp structured and arranged to clamp such unitary display holder onto a portion of a store fixture, and at least one flat slot structured and arranged to assist removable attachment of such unitary vertical strip display to such unitary display holder; wherein such at least one flat hook is hooked into such at least one flat slot. And, it provides such a retail display system wherein: such retail display system is structured and arranged to prevent removal from such at least one flat slot of such unitary vertical strip display when such unitary display holder is clamped so that such at least one flat slot is closely adjacent the portion of the store fixture. Further, it provides such a retail display system further comprising: a hanger display system, for removeable attachment with such display means, for use in conjunction with such retail display system, for combined control of inventory and merchandise displayed for sale, comprising a plurality of holding means for holding the merchandise; and at least one vertical support means for supporting such plurality of holding means; wherein such attachment means attaches such at least one vertical support means to such retail display system; wherein each such plurality of holding means is shaped and arranged for a holding a specified kind of product; and wherein each of such plurality of holding means is further shaped and arranged for holding a specified quantity of such specified kind of product. Even further, it provides such a retail display system further comprising: a hanger display system, adapted to removeably attach with such unitary display holder, adapted to use in conjunction with such retail display system, adapted to use in combined control of inventory and merchandise displayed for sale, comprising a plurality of holders adapted to hold the merchandise; and at least one vertical support adapted to support such plurality of holders; wherein such at least one connector connects such at least one vertical support to such retail display system; wherein each of such plurality of holders is shaped and arranged for a holding a specified kind of product; and wherein each of such plurality of holders is further shaped and arranged for holding a specified quantity of such specified kind of product.

Moreover, it provides such a retail display system wherein such at least one clamp comprises at least one tightening screw structured and arranged to attach such at least one clamp onto such portion of such store fixture. In accordance with another preferred embodiment hereof, this invention provides a hanger display system, used in conjunction with a retail merchandising fixture, for combined control of inventory and merchandise displayed for sale, comprising: holding means for holding the merchandise; vertical support means for supporting such holding means; and attachment means for attaching such vertical support means to the merchandising fixture; wherein such holding means is structured and arranged to hold a specified kind of product; and wherein such holding means is further structured and arranged to hold a specified quantity of such specified kind of product.

Additionally, it provides such a hanger display system wherein such attachment means is selected from the following group consisting of: hook means for hooking such vertical support means to a wire grid of the retail merchandise fixture; clamp means for clamping such vertical support means to the retail merchandise fixture; and faceplate means, having an aperture and being removably attachable to such retail merchandise fixture, for attaching such vertical support means. Also, it provides such a hanger display system wherein such faceplate means is structured and arranged to remind a user of the nature and service of the merchandise displayed for sale. In addition, it provides such a hanger display system wherein such vertical support means further comprises indicia means for displaying indicia. And, it provides such a hanger display system wherein such holding means further comprises at least one safety ring.

In accordance with another preferred embodiment hereof, this invention provides a hanger display system for at least one particular retail business location having at least one set of available product-desired-spaces comprising the steps of: analyzing data of a plurality of products; allowing space to each such plurality of products; designing displays for displaying each such product to each such space; producing such displays; wherein each such display comprises, holding means for holding the merchandise; vertical support means for supporting such holding means; and attachment means for attaching such vertical support means to the merchandising fixture; wherein such holding means is structured and arranged to hold a specified kind of product; and wherein such holding means is further structured and arranged to hold a specified quantity of such specified kind of product.

In accordance with another preferred embodiment hereof, this invention provides a hanger display system, used in conjunction with a retail merchandising fixture, for combined control of inventory and merchandise displayed for sale, comprising: a plurality of holders to hold the merchandise; at least one vertical support to support such plurality of holders; and at least one attacher to attach such at least one vertical support to the merchandising fixture; wherein such plurality of holders are structured and arranged to hold a specified kind of product; and wherein such plurality of holders are structured and arranged to hold a specified quantity of such specified kind of product.

Further, it provides such a hanger display system wherein such at least one attacher is selected from the following group comprising: at least one hook structured and arranged to hook such at least one vertical support to a wire grid of the retail merchandise fixture; at least one clamp structured and arranged to clamp such at least one vertical support to the retail merchandise fixture; and at least one faceplate, having an aperture and being removably attachable to such retail merchandise fixture, structured and arranged to attach such at least one vertical support. Even further, it provides such a hanger display system wherein such at least one faceplate is structured and arranged to remind a user of the nature and service of the merchandise displayed.

Even further, it provides such a hanger display system, wherein such attachment means comprises: unitary display means having at least one front face for displaying retail sales indicia and having at least one rear face; and wherein such display means comprises on such at least one rear face, clamping means for clamping such display means on a portion of a store fixture which is not a horizontal shelf; and attachment means for removably attaching such vertical support means.

BRIEF DESCRIPTION OF THE DRAWINGS

FIG. 1 is a perspective view of a preferred embodiment of the retail display system of the present invention.

FIG. 2 is a front view of the faceplate of the embodiment of FIG. 1.

FIG. 3 is a perspective view of the mounting bracket of the embodiment of FIG. 1.

FIG. 4 is a plan view of the mounting bracket of FIG. 1 showing the mounting bracket in an installed position on a typical wood end-cap display.

FIG. 5 is a side view of the hook strip attachment of the retail display system of FIG. 1.

FIG. 6 is a perspective view of the hook strip attachment shown in FIG. 5.

FIG. 7 is a side view, partially in section, of the preferred embodiment of FIG. 1 illustrating the installation of the hook strip attachment to the faceplate.

FIG. 8 is a side view, partially in section, illustrating the secure position of the hook strip attachment.

FIG. 9 is a perspective view of another preferred embodiment of the hook strip attachment of the retail display system.

FIG. 10 is a side view, partially in section, of the hook strip attachment of FIG. 9.

FIG. 12 is a perspective view of a preferred embodiment of the mounting bracket of FIG. 1 with additional set screws.

FIG. 17 is a front view showing another preferred embodiment of the faceplate of the retail display system.

FIG. 18 is a front view showing yet another preferred embodiment of the faceplate of the retail display system.

FIG. 19 is a front view showing yet another preferred embodiment of the faceplate of the retail display system.

FIG. 20 is a front view showing yet another preferred embodiment of the faceplate of the retail display system with yet another preferred embodiment of a label type and label position.

FIG. 21 is a sectional view through the section 21-21 of FIG. 20.

FIG. 22 is a perspective view of yet another preferred embodiment of the mounting bracket of the retail display system.

FIG. 23 is a side view partially in section of the faceplate and hook strip attachment installation procedure of the embodiment shown in FIG. 22.

FIG. 24 is a perspective view of yet another preferred embodiment of the mounting bracket of the retail display system.

FIG. 25 is a side view, partially in section, of the embodiment of FIG. 24.

FIG. 26 is a side view partially in section of the faceplate and hook strip display installation procedure of the embodiment shown in FIG. 25.

FIG. 27 is a perspective view of yet another preferred embodiment of the mounting bracket of the retail display system.

FIG. 28 is a side view, partially in section, through the embodiment of FIG. 27.

FIG. 29 is a perspective view of yet another preferred embodiment of the mounting bracket of the retail display system.

FIG. 30 is a perspective view of yet another preferred embodiment of the faceplate of the present invention.

FIG. 31 is a side section view through the embodiment of FIG. 30.

FIG. 32 is a perspective view showing another preferred embodiment of a label type and position.

FIG. 33 a perspective view of yet another preferred embodiment of the faceplate of the present invention.

FIG. 34 a perspective view of yet another preferred embodiment of the mounting bracket of the retail display system.

FIG. 41 is a plan view, partially in section, of the embodiment of FIG. 40.

FIG. 42 is a perspective view of yet another preferred embodiment of the mounting bracket of the retail display system.

FIG. 43 is a top view of the embodiment of FIG. 42.

FIG. 44 is a perspective view of yet another preferred embodiment of the mounting bracket of the retail display system.

FIG. 45 is a side view, partially in section, of the embodiment of FIG. 44.

DETAILED DESCRIPTION OF A PREFERRED EMBODIMENT OF THE INVENTION

Figure 11:
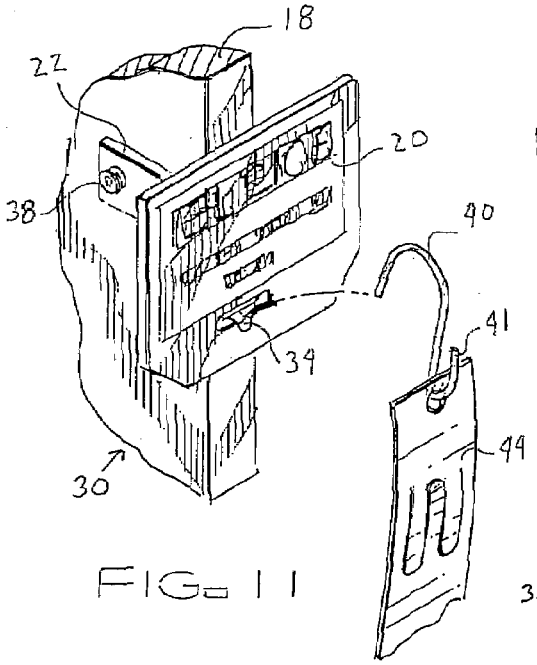
FIG. 11 is a perspective view of yet another preferred embodiment of a hook strip attachment of the retail display system.

FIG. 1 is a perspective view of a preferred embodiment of the present invention, a retail display system 30. The basic parts of the retail display system 30 are a faceplate 20 with an integral faceplate rear mounting bracket 22, a separate hook strip 26 with separate spaced hooks or clips 28 (illustrated in FIG. 1 supporting various articles of merchandise) and an integral flat hook 24 for attaching the hook strip 26 to the faceplate 20. The retail display system 30 is shown in FIG. 1 attached to a vertical end-piece portion 18 of a typical retail store display fixture 16. Preferably, the separate hook strip 26 comprises at least one, most preferably a plurality of clips 28 (at least embodying herein wherein such at least one merchandise display hanger comprises a plurality of merchandise display clips).

Illustrated in FIG. 2 is a preferred embodiment of a faceplate 20. Preferably, faceplate 20 is adaptable to comprise various sizes, each preferably consisting of a single stamped steel plate. It is understood that, under appropriate circumstances, other suitable materials may be substituted for steel to produce alternate preferred embodiments of the present invention. Further illustrated in FIG. 2, preferably at the bottom of the faceplate 20, preferably centered and approximately ⅜" above the bottom edge 27 of the faceplate, is a faceplate aperture 32, as shown. The faceplate aperture 32 is preferably formed such that it comprises a generally elongated slot 33 (preferably about ⅛" to about 3/16" in height by about ⅛" to about 2" in length with ⅛"-radiused corners at both ends) formed to fit the flat hook strip attachment 24 shown previously in FIG. 1. In the center bottom portion of the slot 33 as illustrated in FIG. 2, another aperture 34 is formed in the slot 33 preferably sized such that the aperture 34 will allow an about ¼" round hook strip attachment 25 as shown in FIG. 9 and described later to fit into aperture 34.

Illustrated in FIG. 3 is a perspective view showing a preferred embodiment of the mounting bracket 22 of FIG. 1. Preferably, the mounting bracket 22 consists of a "U" shaped bracket that is welded to faceplate 20. In a preferred embodiment, the mounting bracket 22 has two set screws 38 that fit into set screw apertures 42 and are preferably of a type that may be tightened by use of an "Allen" wrench. Preferably, the mounting bracket 22 functions as a clamp as the set screws are tightened against the substrate upon which the mounting bracket 22 is installed (at least embodying herein wherein such at least one attacher comprises at least one clamp). The opening of the mounting bracket 22 "U" is variable; however, an about ½" to about 4" opening is preferred in order to be mounted over the majority of preferred store fixture construction materials.

FIG. 4 is a plan view of the embodiment of FIG. 3 shown in an installed position on a typical end-cap merchandise fixture comprising a vertical end piece 18. FIG. 4 illustrates the attachment means provided by the combination of the mounting bracket 22 and a preferred embodiment of tightening (clamping) the mounting bracket 22 to the vertical end piece 18, preferably using two set screws 38 attached from a single side of the mounting bracket 22. There are multiple preferred embodiments of the set screw attachments as will be described further below.

FIG. 5 is a side view of a preferred embodiment of a flat hook strip attachment 24 of the retail display system 30. Preferably, the hook strip 36 (hook strip 26 of FIG. 1) comprises an elongated stem 35, unitary in construction, with an upper hook strip attachment 24, which may be round or more preferably flat, as shown in FIG. 5. The flat hook strip attachment 24 is preferably a flat metal bar 48 approximately ⅛" in thickness and about ⅜" to about 2" in width (at least embodying herein at least one bar, comprising at least one width, and at least one thickness, wherein such at least one width is substantially greater than such at least one thickness).

Preferably, the flat metal bar 48 extends approximately 2½" to about 4" in length and is bent in the middle with a 180-degree arc/radius 46 to produce a hook segment 49, as shown. Preferably, the hook segment 49 comprises a segment length (preferably about 1½" to about 3") adapted to pass through the faceplate aperture 32 (see FIG. 7) and be secured from removal during installation of the flat hook strip attachment 24 to the faceplate aperture 32, as shown. Preferably, the hook segment 49 is oriented substantially parallel to the elongated stem 35, located on the opposite side of the bend, as illustrated in FIG. 5 (at least embodying herein at least one first substantially linear segment comprising at least one first segment length; and at least one second substantially linear segment comprising at least one second segment length; wherein such at least one first substantially linear segment and such at least one second substantially linear segment are connected by at least one bend so that such at least one first substantially linear segment and such at least one second substantially linear segment are substantially parallel and offset from each other).

Preferably, the flat hook strip attachment 24 (at least embodying herein at least one hook structured and arranged to removably engage such at least one aperture) is formed such that the outer flat peripheral shape closely matches the slot-shaped opening of the faceplate aperture 32 previously illustrated in FIG. 2. This preferred arrangement limits "side-to-side" swinging of the flat hook strip attachment 24 wherein rotation of the flat hook strip attachment 24 is restricted about an axis oriented substantially perpendicular to the front face 29 and the rear face 31 of the faceplate 20 (at least embodying herein wherein such at least one hook and such at least one elongated slot are structured and arranged so that such at least one hook closely fits within such at least one elongated slot to restrict rotation of such at least one merchandise display hanger about at least one axis oriented substantially perpendicular to such at least one front face). This preferred feature assists in maintaining the elongated stem 35 in a substantially vertical display position, thereby reducing spillage of merchandise due to an accidental (or malicious) side impact.

Preferably, the elongated stem 35 comprises hooks/clips 37 installed along its vertical length for the preferred purpose of clipping on merchandise to be displayed for sale (at least embodying herein at least one merchandise support member structured and arranged to support merchandise). These hooks and clips 37 may be spaced at assorted intervals to accommodate a variety of packaging sizes. When the flat hook strip attachment 24 is inserted through the faceplate aperture 32, and the mounting bracket 22 is tightened securely against the wood end-cap display vertical end piece 18, the flat hook strip attachment 24 is secured from removal. The unique securability of the flat hook strip attachment 24 is important in the prevention of theft of the entire hook strip 26.

Preferably, the flat hook strip attachment 24 is engaged and disengaged with the faceplate aperture 32 by rotating the flat hook strip attachment 24 until the structure of the faceplate 20 no longer blocks the passage of the hook segment 49 through the faceplate aperture 32, as best illustrated in FIG. 7 (at least embodying herein wherein such at least one hook and such at least one aperture are structured and arranged so that such at least one merchandise display hanger can be removably attached to such at least one support plate by inserting such at least one hook into such at least one aperture). Preferably, the flat hook strip attachment 24 is "locked" into place as it is positioned against the vertical end piece portion 18 and held firmly in place by the faceplate 20. More specifically, the faceplate 20 and the flat hook strip attachment 24 are structured and arranged so that attaching the faceplate 20 adjacent the substantially flat surface of vertical end-piece portion 18 restricts rotation of the flat hook strip attachment 24 to prevent the reorienting of the flat hook strip attachment 24 to a position allowing removal from the faceplate aperture 32 (at least embodying herein wherein such at least one attacher, such at least one hook, and such at least one aperture are structured and arranged so that attaching such at least one attacher restricts the relative angular position of such at least one merchandise display hanger and such at least one support plate so that such at least one hook cannot be removed from such at least one aperture and further embodying herein wherein such at least at least one support plate and such at least one merchandise display hanger are structured and arranged so that attaching such at least one support plate adjacent a substantially flat surface restricts rotation of such at least one hook so that such at least one hook cannot be removed from such at least one aperture). Preferably, for best security, the radius of the arc 46 should be under 2" for most applications, with a highly-preferred radius of about ⅛". FIG. 6 is a perspective view of the preferred embodiment of a flat hook strip attachment 24 shown in FIG. 5, further illustrating the component parts of a preferred embodiment of a flat hook strip attachment 24 as described above.

FIG. 7 illustrates the installation method of the flat hook strip attachment 24 to the faceplate 20 of the mounting bracket 22 using the faceplate aperture 32. The mounting bracket 22 is placed at about 45 degrees to the perpendicular flat hook strip attachment 24 which is then inserted through the faceplate aperture 32 until the flat hook strip attachment 24 is resting on the point of the 180 degree radius 46. It is clear from the illustrated depiction of FIG. 7 that the flat hook strip attachment 24 and the faceplate aperture 32 are both structured and arranged so that the flat hook strip attachment 24 can be removably inserted into the faceplate aperture 32 when the flat hook strip attachment 24 and the faceplate 20 are in a first relative angular position (about 45 degrees). Referring to the illustrated depiction of FIG. 8, preferably, the flat hook strip attachment 24 and the faceplate aperture 32 are also structured and arranged such that the flat hook strip attachment 24 cannot be removed from the faceplate aperture 32 when the flat hook strip attachment 24 and the faceplate 20 are rotated into a second (substantially vertical) angular position, as shown. The above-described arrangement at least embodies herein wherein such at least one hook and such at least one aperture are structured and arranged so that such at least one hook can be removably inserted into such at least one aperture when such at least one merchandise display hanger and such at least one support plate are in a first relative angular position; and wherein such at least one hook and such at least one aperture are structured and arranged so that such at least one hook cannot be removed from such at least one aperture when such at least one merchandise display hanger and such at least one support plate are rotated into a second relative angular position.

A preferred "non-disengageable" coupling of the hook strip attachment 24 to the faceplate 20 is achieved with the connection of the hook strip attachment 24 through the faceplate aperture 32 (with the hook strip attachment 24 and the faceplate 20 resting in the generally vertical position depicted in FIG. 8), and the mounting bracket 22 of the faceplate 20 firmly clamped to a store display vertical end-piece 18, as shown. More specifically, the mounting bracket 22 is preferably adapted to position the hook strip attachment 24 between the faceplate 20 and the vertical end-piece 18 to prevent rotation of the hook strip attachment 24 to a position allowing removal (at least embodying herein wherein such at least one attacher, such at least one hook, and such at least one aperture are structured and arranged so that attaching such at least one attacher prevents removal of such at least one hook). This preferred arrangement is an important improvement as theft of the hook strips and the contents is an industry problem for this type of display. The first described embodiment of such attachment is shown as two set screws tightly screwed-in to the store fixture vertical end-piece 18.

FIG. 9 is a perspective view of another preferred embodiment of the hook strip attachment 25 of the retail display system. In this preferred embodiment, the hook strip attachment 25 is preferably round consisting of approximately a 3" diameter round metal hook, about 2½" to about 4" in length. The hook strip attachment 25 is a hook strip widely available and utilized by those knowledgeable in the art. The preferable connection of the hook strip attachment 25 and the mounting bracket 22 is when both the mounting bracket 22 and hook strip attachment 25 are resting connected through the faceplate aperture 32 and are perpendicular to the ground. In this embodiment, the hook strip attachment 25 is installed using aperture 34. As illustrated in FIG. 9, round aperture portion 34 is structured and arranged to allow a ¼" round hook strip attachment 25 to be installed in the faceplate aperture 32. When connected in the above described manner, the mounting bracket 22 is then attached to a store display vertical end-piece 18. The embodiment of such attachment is shown as two set screws tightly screwed-in to the store fixture vertical end-piece 18. The configuration of the perpendicular parts provides an attachment of the mounting bracket 22, faceplate 20, and hook strip attachment 25 such that the hook strip attachment 25 cannot be removed without the entire mounting bracket 22 being removed. This is a preferred improvement over the previous art in this area for this type of hook strip as the present invention deters theft of the hook strip.

FIG. 10 is a side view, partially in section, of the hook strip attachment of FIG. 9. FIG. 10 further illustrates the attachment of aperture 34, an about ¼" round hook strip attachment 25 installed in the faceplate aperture 32 and through aperture 34, an about 3" hole matching the thickness of the hook strip attachment 25. Preferably, the installation in this manner provides a secure connection of the hook strip 25 to the faceplate 20. FIG. 10 also illustrates the preferred "Allen wrench" type set screw face 39 shown in side view and mounted in a preferable location on the mounting bracket 22.

FIG. 12 illustrates another preferred embodiment of the mounting bracket 23. This preferred embodiment of the mounting bracket 23 consists of a "U" shaped bracket which is preferably welded to faceplate 20. There are four set screws 38 used to tighten the bracket 23 to the vertical store fixture portion 18 (see FIG. 10). Preferably, two set screws 38 are positioned on each side of mounting bracket 23. The four set screws 38 fit into set screw apertures 42 and are preferably the type that may be tightened by use of an "Allen" wrench, matching the set screw face 39 previously shown in FIG. 10. The four set screw 38 embodiment is preferable when the various hook strip embodiments are to display heavier types of merchandise.

FIG. 11 illustrates yet another preferred embodiment of a hook strip attachment, an "S" hook 40. Preferably, "S" hook 40 is made of about 3" of rounded wire and is inserted into aperture 34 of the faceplate 20. The lower end of "S" hook 40 attaches to yet another embodiment of the hook strip, a plastic "card strip" 44. "S" hook 40 has a top portion which hooks into the faceplate 20 and lower portion which has a hook end 41. Hook end 41 is used to attach a plastic card strip 44 to the present invention. The card strip 44 is not new to the art and is another device commonly used to display merchandise, usually in pre-packaged plastic bags. In this embodiment, the attaching of the card strip 44 to a fixture for display, and the labeling of the items on the retail display system 30, is an improvement on the current art.

The present invention provides other improvements in the display of the labeling, including display of common types of bar code labels, advertising labels, and pricing labels. These display improvements and their embodiments are described below as a part of the retail display system 30.

Figure 13:
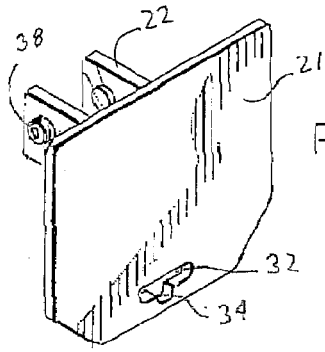
FIG. 13 is a perspective view of the faceplate of the retail display system of FIG. 1, showing another preferred embodiment of the mounting bracket.

FIG. 13 is a perspective view of a preferred embodiment of the faceplate of the retail display system 30 with yet another preferred embodiment of mounting bracket 22. The faceplate portion 21 is preferably sized at about 2⅝" high by about 2-0" wide to accommodate a standard label. Mounting bracket 22 consists of two set screws 38, one each on each side of the mounting bracket 22 approximately 1¾" to 3" inset from the end opposite the faceplate 21 of the mounting bracket 48.

Figure 14:
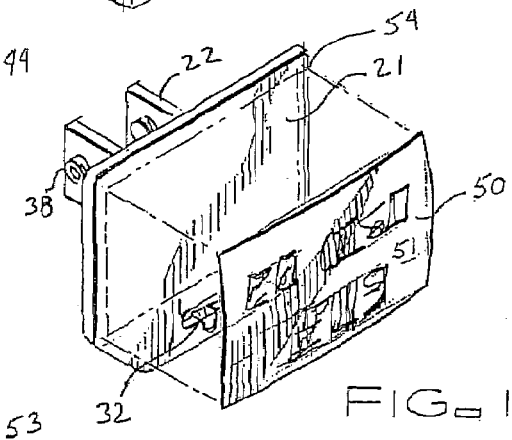
FIG. 14 is a perspective view of the faceplate of the retail display system of FIG. 1, showing a preferred embodiment of a label and label position.

FIG. 14 is a perspective view of a faceplate 21 of the retail display system 30 with an embodiment of a preferred label 50 and label position 54 (at least embodying herein wherein such at least one front face is structured and arranged to display merchandising indicia). Preferably, this embodiment of label 50 is a rectangular label that contains all its information on the face 51 of the label 50. Label 50 is positioned such that it covers about 2⅝" by 1½" of the faceplate 21, leaving the hook strip mounting apertures, previously described as faceplate aperture 32 and aperture 34 in FIG. 2, uncovered. Preferably, label 50 is adhesively attached to faceplate 21. Preferably, the adhesive is such that it removably adheres the label 50 (allowing the label to be removed). This feature will allow for easier replacement of the label 50 as the merchandise attached to the retail system 30 is changed.

Figure 15A:
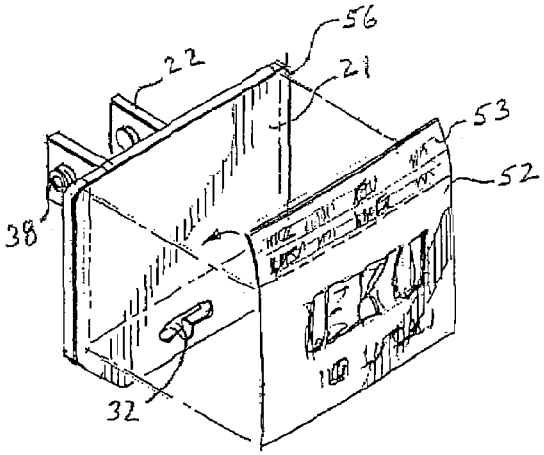
FIG. 15A is a perspective view of the faceplate of the retail display system of FIG. 1, showing another preferred embodiment of a label and label position.
Figure 15B:
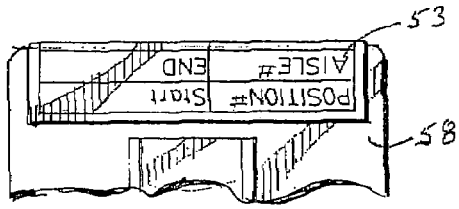
FIG. 15B is a close-up view of the label shown in FIG. 15A as it would appear folded over the rear of the faceplate shown in FIG. 15A.

FIG. 15A is a perspective view of the faceplate of the retail display system 30 showing another embodiment of a label type and label position on the faceplate. As illustrated in FIG. 15A, label 52 consists of a rectangular shaped label preferably sized approximately 2⅝" by 2-¼" with ¾" of the upper portion of label 52 consisting of a bar code label 53. Label 52 is positioned to be adhesively attached to the faceplate 21 in position 56 such that bar code label 53 folds over the top of faceplate 21 and is adhesively attached to the rear of the faceplate 58. The position of the adhesively attached bar code label 53 to the rear of the faceplate 58 is further illustrated by FIG. 15B.

Figure 16:
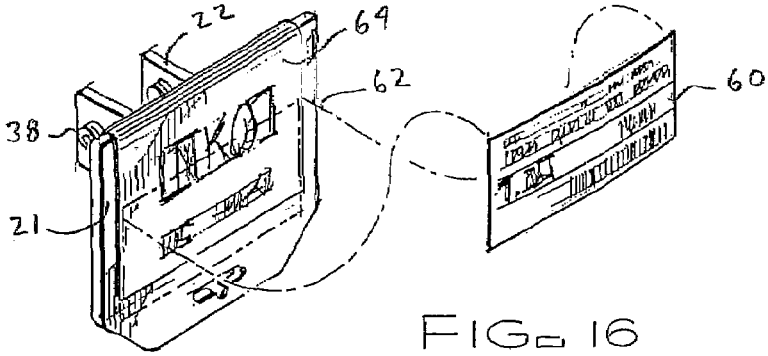
FIG. 16 is a perspective view of the faceplate of the retail display system of FIG. 1, showing yet another preferred embodiment of a label type and label position.

Store retail displays often require changes in pricing information or changes in the stock numbers or a variety of other possible changes that need to be reflected on the labeling system. FIG. 16 is a perspective view of a faceplate representing yet another preferred embodiment of a label type and position with another bar code label 60 and bar code position 62 illustrated. In this embodiment, the label 64 is shown as adhesively attached. In order to provide the ability to change label types and information, this embodiment provides that bar code label 60 may be adhesively attached to label 64.

FIG. 17, FIG. 18, and FIG. 19 represent yet further embodiments of label sizing. FIG. 17 is a frontal view showing a preferred embodiment of the faceplate 70 of the retail display system. In this embodiment the faceplate 70 is preferably sized about 1¼" wide by 3½" high, the label 70 area being ⅜" less in height to allow for the faceplate aperture 32 to be left uncovered for connection to a hook strip. FIG. 18 is a frontal view showing still another preferred embodiment of the faceplate 71 of the present invention. In this embodiment, the faceplate 71 is preferably sized about 1¼" wide by 2-0" high, the label area being ⅜" less in height to allow for the faceplate aperture to be uncovered. FIG. 19 is a frontal view showing yet another preferred embodiment of the faceplate 72 of the retail display system. In this embodiment, the faceplate 72 is sized about 2⅝" wide by 3½" high, the label area being ⅜" less in height to allow for the faceplate aperture 32 to be uncovered.

FIG. 20 is a frontal view showing yet another preferred embodiment of the faceplate of the retail display system with yet another preferred embodiment of a label type and position. In this embodiment, the faceplate 74 is preferably sized about 2⅝" wide by 3½" high. Preferably, a separate label holder 76 is rigidly attached to the faceplate 74, preferably by welding. Label holder 76 is a label holder common in the grocery store retail business and holds a label 78 that is preferably sized about 1¼" high by 2½" wide. Label holder 76 holds a label 78 that is placed into the label holder 76 and is preferably not adhesively attached. Label holder 76 is further illustrated in FIG. 21, a side section view through FIG. 20. In addition, illustrated in FIG. 21 is label 78 shown held in label holder 76 by two horizontal grooves 77.

FIG. 22 is a perspective view of yet another preferred embodiment of the mounting bracket 82 of the retail display system 30. This embodiment is manufactured to accommodate another common retail store display, a wire grid system. Typically this wire grid system is made up of ¼" round metal wire 84 which is weldably manufactured in an about 2" to 4" square grid pattern. These wire grids are sized about 1' by 1' to about 4' by 8' square. Preferably, mounting bracket 82 is installed as part of the grid system when the grid system is manufactured. Further illustrated in FIG. 23 is a side section view of the faceplate and hook strip display installation procedure of the embodiment shown in FIG. 22. As previously shown in FIG. 7, the installation procedure for the embodiment shown in FIG. 23 is similar to that of FIG. 7. The mounting bracket 82 allows for the faceplate 80 to be swung out at about a 45-degree angle to the perpendicular hook strip attachment 24, which is then inserted through the faceplate aperture 32 until the hook strip attachment 24 is resting on the 180 degree radius/arc 46 point.

Yet another embodiment of the rear mounting bracket of the retail display system 30 is illustrated in FIG. 24. This embodiment is also configured to fit the wire grid system described above. The embodiment illustrated in FIG. 24 provides for the retail display system 30 to be attached at two points along the wire grid round metal wire 84. This additional attachment over the previous embodiment provides for additional securing of the retail display system 30 on the wire grid display. FIG. 24 represents this embodiment of the mounting bracket in an installed position. Preferably, an about ⅛" thick metal plate 89 has two tubular steel pieces 84 approximately 1" in length attached at the top, i.e., attachment 88 and bottom attachment 90 of the metal plate 89. Preferably, attachment 90 has an about ¼" wire 92 inserted into it. Wire 92 extends approximately 2" past each end of attachment 90. Preferably, wire 92 is welded to the rear of faceplate 94. Wire 92 is welded in a position such that it places plate 89 in the center of the rear of faceplate 94. Clip attachment 86 is placed on the rear of faceplate 94 such that attachment 88 will snap into it and lock into place. Clip attachment 86 is preferably comprised of an about 1" wide and about 1/16" thin steel plate of a length long enough to be bent in such a radius to allow attachment 88 to fit into it. When attachment 88 is installed on a wire grid system previously discussed above, these embodiments may be used as further illustrated in FIG. 25.

FIG. 25 illustrates the retail display system 30 with a hook attachment 96 which may be any of the previously discussed embodiments of a hook attachment. Installation of the hook attachment 96 occurs similarly to the previous embodiments. Referring to FIG. 26, plate 89 swings out from the faceplate 94 as it pivots on attachment 90 which allows for the faceplate 94 to be swung out at about a 45-degree angle to the perpendicular hook strip attachment 96, which is then inserted through the faceplate aperture 32 until the hook strip attachment 96 is resting on the point of the 180 degree radius 98.

FIG. 27 is a perspective view of yet another preferred embodiment of the rear mounting bracket 102 of the retail display system 100. This preferred embodiment provides a mounting bracket 102 for attaching to the long side 106 of vertical gondola stanchions 104 commonly used in supporting shelving in retail stores and well known by those knowledgeable in the art.

FIG. 28 is a side section view through the embodiment of FIG. 27 and illustrates the position of the mounting bracket 102 when installed in the vertical gondola stanchion 104.

Preferably, the mounting bracket 102 is attached to the faceplate 114, preferably by welding. Mounting bracket 102 is inserted into the long side 106 of the top opening 101 of the vertical gondola stanchion 104 and pressed into place. Preferably, the mounting bracket 102 is manufactured such that it is made of steel, bent and sprung such that the mounting bracket 102 will compress as it is placed into the vertical gondola stanchion 104 and be tightly held in place once positioned. Preferably, the mounting bracket 102 is about ⅞" wide by about 1¼" in height.

FIG. 29 is a perspective view of yet another preferred embodiment of the rear mounting bracket 110 of the retail display system 109. Mounting bracket 110 is inserted into the short end 108 of the top opening 101 of the vertical gondola stanchion 104 and pressed into place. Preferably, the mounting bracket 110 is manufactured such that it is made of steel, bent and sprung such that the mounting bracket 110 will compress as it is placed into the vertical gondola stanchion 104 and be tightly held in place once positioned. Preferably, the mounting bracket 110 is about ⅜" wide by about 1¼" in height.

FIG. 30 is a perspective view of yet another preferred embodiment of the faceplate of the present invention. In this embodiment, the faceplate 120 is such that it has an integral semi-circular base plate 122 perpendicular to the faceplate 120. Base plate 122 is constructed to hold an existing hook strip attachment 128. Preferably, base plate 122 has an aperture 124 located in the center of the base plate 122. Aperture 124 is a round hole approximately ¼" in diameter to correspond to the diameter of the hook strip attachment 128 wire thickness. Further, base plate 122 has three semi-circular apertures, one each at spaced peripheral positions: position 125, position 126 and position 127. These apertures are also about ¼" in diameter to correspond to the diameter of the hook strip attachment 128 wire thickness. As illustrated in FIG. 30 and further illustrated in FIG. 31, hook strip attachment 128 is inserted into any one of the three peripheral apertures (position 125, position 126 or position 127) in combination with the center aperture 124. In this manner retail display system 140 may be used in combination with faceplate 120, base plate 122 and one or more of the many embodiments of the mounting hardware and label embodiments described above.

FIG. 32 is a perspective view showing still another preferred embodiment of a label and label position. FIG. 32 illustrates an electronic label 142 attached to the faceplate 144. Electronic label 142 is another type of label used in the retail display industry. The mounting bracket 148 may be any one of the many combinations described above. The aperture 146 may also be any one of the embodiments described above. The preferred aperture 146 is (best described by referring back to FIG. 2) formed such that it comprises a slot 33 about ⅛" to about 3/16" in height by about ⅛" to about 2" in length with about ⅛"-radiused corners at both ends. In the center bottom portion of the slot 33, as illustrated in FIG. 2, another aperture 34 is formed in the slot 33 such that the aperture 34 will allow a (preferably about ¼") round hook strip attachment 25 (as shown in FIG. 9). The aperture 146 is formed to fit the hook strip attachment 24 (shown previously in FIG. 1).

Referring now to FIG. 33, illustrated is yet another preferred embodiment of a faceplate 147 and hook strip apertures 148 of the present invention. Preferably, there are multiple hook strip apertures 148. Preferably, there are five hook strip apertures 148, as shown. Preferably two or three apertures are used at any one time as illustrated, to allow for spacing requirements of the hook strips 150 and the merchandise which is attached to such hook strips. This embodiment may be combined with any of the illustrated faceplate configurations or hardware combinations described herein.

Figure 35:
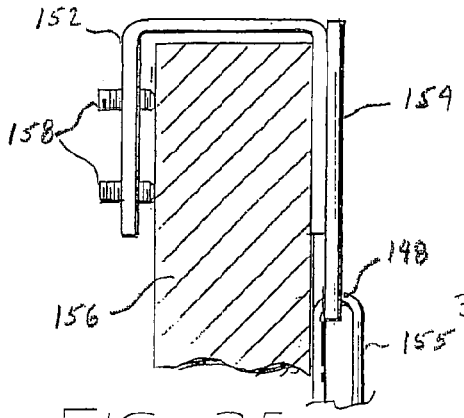
FIG. 35 is a side view, partially in section, of the embodiment of FIG. 34.

FIG. 34 a perspective view of yet another preferred embodiment of the mounting bracket of the retail display system. Preferably, in this embodiment the mounting bracket 152 is attached to the rear of the faceplate 154 such that the mounting bracket 152 may be attached vertically, as shown, to a portion of a merchandise display end piece 156. There are two set screws (preferably "Allen"-type) 158 attached in a vertically linear fashion, as shown, and operating as previously described above. FIG. 35 is a side section view of the embodiment of FIG. 34 further illustrating the attachment of the mounting bracket 152 and the placement of the faceplate 154 relative to the mounting bracket 152. The hook strip 155 attaches and operates as previously described above (see FIGS. 7 and 8).

Figure 36:
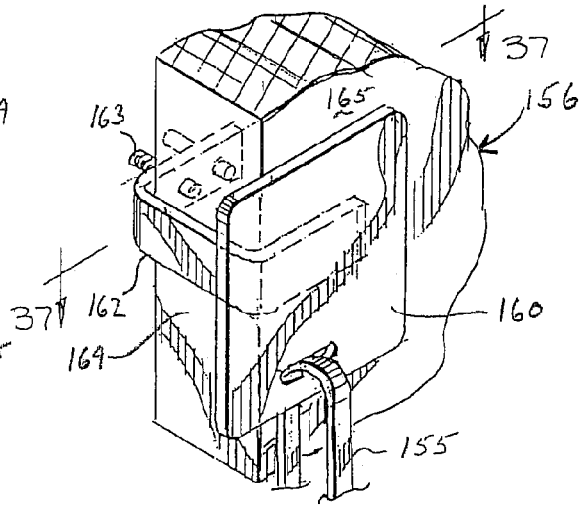
FIG. 36 is a perspective view of yet another preferred embodiment of the mounting bracket of the retail display system.
Figure 37:
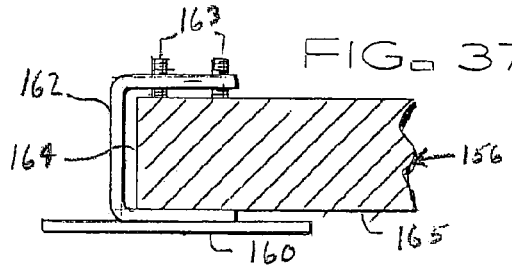
FIG. 37 is a plan view, partially in section, through the section 37-37 of FIG. 36.

FIG. 36 is a perspective view of yet another preferred embodiment of the mounting bracket of the retail display system, and FIG. 37 is a top cut-away plan view through FIG. 36. As illustrated in FIGS. 36 and 37, the mounting bracket 162 is attached to the faceplate 160 such that faceplate 160 mounts on the vertical face 165 of the merchandise display end piece 156. The mounting bracket 162 attaches to the side 164 of the merchandise display end piece 156, as shown. Preferably, the mounting bracket 162 is securely attached with at least two set screws 163 (preferably "Allen" type) which are firmly tightened against the merchandise display end piece 156.

Figure 39:
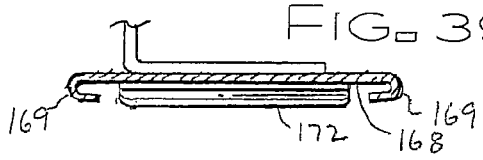
FIG. 39 is a plan view, partially in section, through the section 39-39 of FIG. 38.
Figure 38:
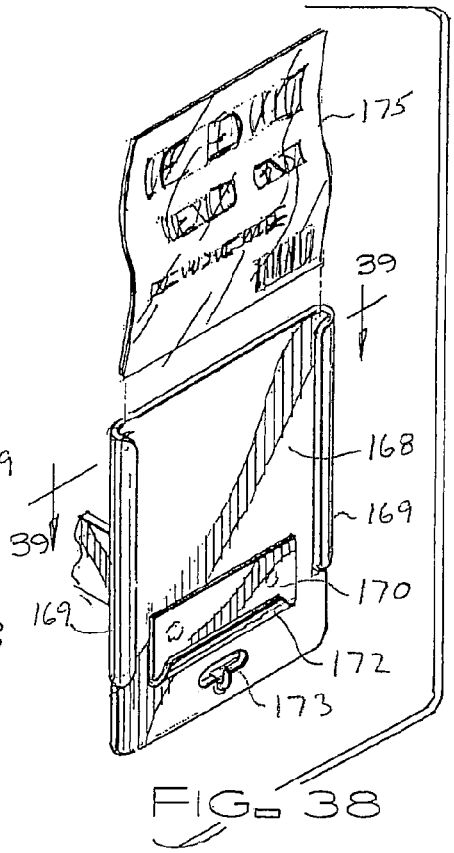
FIG. 38 is a perspective view of yet another preferred embodiment of the faceplate of the present invention.

FIGS. 38 and 39 illustrate yet another preferred embodiment of the faceplate of the present invention. In this embodiment the faceplate 168 is preferably manufactured such that the vertical ends 169 of the faceplate 168 are rolled, as illustrated, in a U-shape, to create a means for the insertion of indicia/label 175 and holding the sides of the indicia/label 175. Ends 169 embody herein at least one vertical groove structured and arranged to removably hold a display label. In addition, a plate 170 is attached to the faceplate 168. Preferably, the plate 170 is manufactured such that the bottom portion 172 of plate 170 is rolled, as illustrated, in a U-shape, to create a means for holding the bottom of the indicia/label 175. The aperture 173 for use with the hook strip 155 is as previously described above and may be substituted for every other above described aperture.

Figure 40:
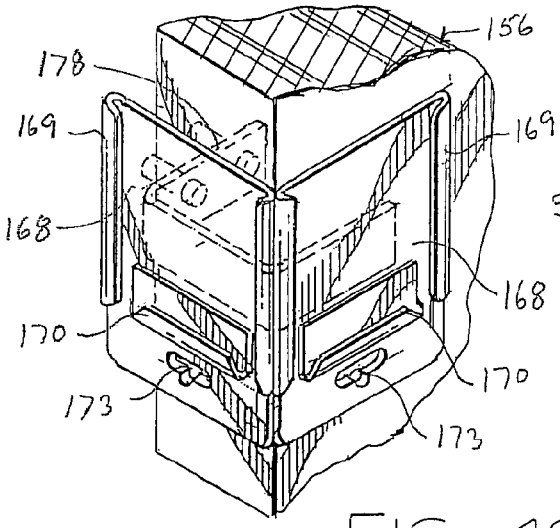
FIG. 40 is a perspective view of yet another preferred embodiment of the faceplate of the present invention and another preferred embodiment of the mounting bracket of the retail display system.

Shown in FIGS. 40 and 41 are perspective and plan views, respectively, of yet another preferred embodiment of the faceplate of the present invention and another preferred embodiment of the mounting bracket of the retail display system. This embodiment consists of two of the above-described faceplates 168 (in FIGS. 38 and 39) attached to a preferably U-shaped mounting bracket 178 in a 90-degree corner configuration as illustrated in FIGS. 40 and 41. This embodiment is preferable when it is desired to use the present invention to display merchandise in two directions on the same fixture and horizontal plane. Preferably, in this embodiment, the mounting bracket 178 is rigidly attached, preferably welded, to the rear of both of the faceplates 168 such that the mounting bracket 178 may be attached horizontally, as shown, to a merchandise display end piece 156. There are at least two set screws 163 attached in a horizontally linear fashion, as shown, and operating as previously described above.

Illustrated in FIGS. 42 and 43 are views of yet another preferred embodiment of the mounting bracket of the retail display system. In this embodiment, the mounting bracket 180 is manufactured to fit a cylindrical portion of a store fixture, typically round, as shown. Alternate clamping arrangements for attaching to a round cylinder are possible with the present invention. However, the bracket 180, as illustrated in FIG. 42, is preferred, preferably consisting of two semi-circular halves 183 and 184, mirrored to each other, with a first end 190 and a second end 192, as shown. The first end 190 is preferably a perpendicular bend 186 oriented away from the pipe portion and parallel to the faceplate 182, attached to the rear 188 of the faceplate 182, as shown. The second end 192 comprises a straight portion extending from the semi-circle in a plane generally perpendicular to the faceplate 182, as shown. The second end comprises two apertures 194, substantially parallel to each other, and sized to allow a bolt 196 to pass through both. The bolt 196 is secured with a nut 198. Preferably, the tightening of the nut 198 against the bolt 196 pulls the two semi-circular halves 183 and 184 together and the retail display 200 is firmly secured on the round cylinder.

FIGS. 44 and 45 are similar views of still another preferred embodiment of the mounting bracket of the retail display system. In this embodiment, the mounting bracket 205 is preferably manufactured to be placed over the upturn vertical lip 202 of a shelve 203. The shelve 203 is typically metal. The mounting bracket 205 is preferably U-shaped as illustrated in FIGS. 44 and 45. The distance of the opening of the "U" shape is variable, however an about ¼" to about ¾" opening is preferred in order to be mounted over the majority of preferred store fixture construction shelve materials. Preferably, two set screws 163 (again, preferably "Allen"-type) are used to secure the mounting bracket 205 to the lip 202 of the shelve 203. The mounting bracket 205 is preferably welded to the back of the faceplate 206. The mounting bracket 205 may be used on any of the above described faceplates.

Figure 46:
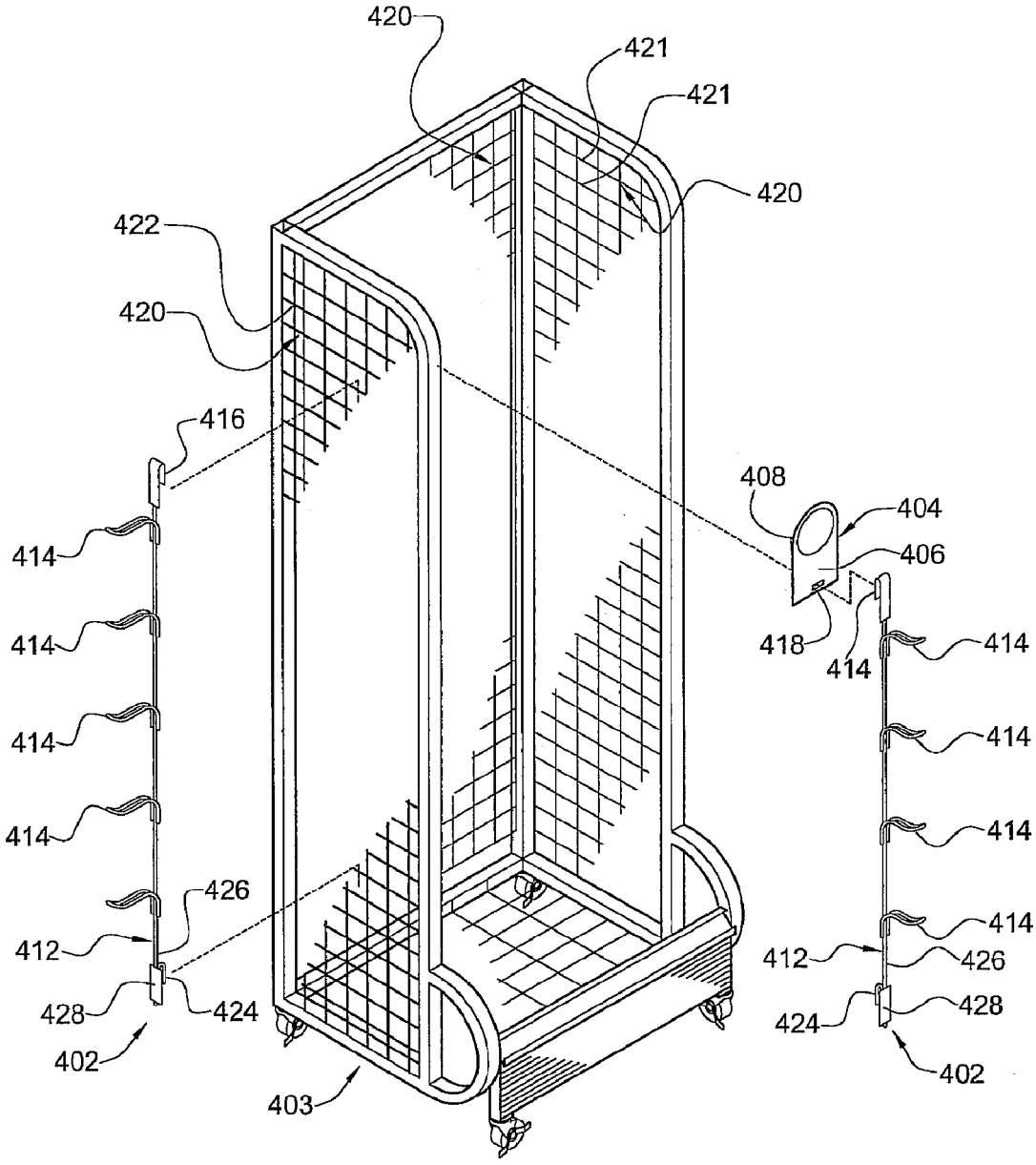
FIG. 46 is a perspective view of the hanger display system as used on a retail display system according to a preferred embodiment of the present invention.

FIG. 46 is a perspective view of a preferred embodiment of the present invention, a hanger display system 400 for increasing density of merchandising of products held by vertical strip displays 402. Preferably, the hanger display system 400 comprises vertical strip displays 402, which are attached to a basic fixture unit 403, such as the one shown. In a preferred embodiment, the vertical strip display 402 comprises a faceplate 404, preferably a unitary plate, preferably metal, having a front face 406 for displaying retail sales indicia and having a rear face 408, with an integral faceplate rear mounting bracket 410 (it is noted that the mounting bracket 410 may be any of the embodiments described in the above-referenced applications or as described herein), a separate peg strip 412, with separate spaced pegs 414, preferably safety pegs, as shown, and an integral flat hook 416, for attaching the peg strip 412 to the faceplate 404.

Preferably, faceplate 404 may be of various sizes consisting of a single stamped steel plate, preferably, comprising an essentially flat surface, however, under appropriate circumstances, other arrangements may suffice (for example, a raised or stamped logo may be added). It is understood that other suitable material may be substituted for steel for suitable applications. Preferably, the steel may be painted in any desired color. Most preferably, the steel is powder coated in any desired color. Preferably, front face 106 comprises indicia, most preferably, such indicia are added as a separate label or other print advertising attached with adhesive, or as directed by the end-user. Under appropriate circumstances, other indicia arrangements may suffice.

Preferably, at the bottom and centered, approximately ⅜" above the bottom edge of the faceplate, is a faceplate aperture 418, as shown. Under appropriate circumstances, other arrangements may suffice. Preferably, the aperture 418 provides an attachment for removably attaching a retail hanger display 402 to a faceplate 404. The faceplate aperture 418 is preferably formed as shown, such that it comprises a slot formed to fit the integral flat hook 416. Under appropriate circumstances, other aperture arrangements may suffice. Preferably, the aperture is structured and arranged to prevent the flat hook 416 from being removed from the aperture 418 when the faceplate 404 is attached adjacent a fixture.

In another preferred embodiment, the vertical strip display 402 attaches directly to the grid 420, as shown. Under appropriate circumstances, other attachment arrangements may suffice. Preferably, the integral flat hook 416 will fit over the grid wire 422, as shown. Preferably, the integral flat hook 416 may be attached over the wire grid 420 such that the wire grid 420 supports the vertical strip display 402, as shown. Preferably, the vertical strip display 402 also comprises a bottom hook-end 424, which is used to secure the lower portion 426 to the wire grid 420, thereby keeping the vertical strip display 402 firmly adjacent the basic fixture unit 403, as shown. Preferably, the integral flat hook 416 and the bottom hook-end 424 are spaced apart such that they will both hook into the wire grid 420. For example, with about 1½" spacing between the horizontal grid wires 421, the integral flat hook 416 and the bottom hook-end 424 would be spaced in intervals of about 24" or about 36" (about every foot) in order to connect easily when inserted through the wire grid 420, and then pushed downward to lock in over the grid wire 422. Under appropriate circumstances, other arrangements may suffice. For example, the bottom hook-end 424 may be more preferably a single bent-plate arrangement.

Preferably, the bottom hook-end 424 also comprises a flat plate 428. Preferably, flat plate 428 comprises indicia. Preferably, indicia added as a label or other advertising media, or both, as directed by the end-user. Under appropriate circumstances, other indicia arrangements may suffice.

Figure 47:
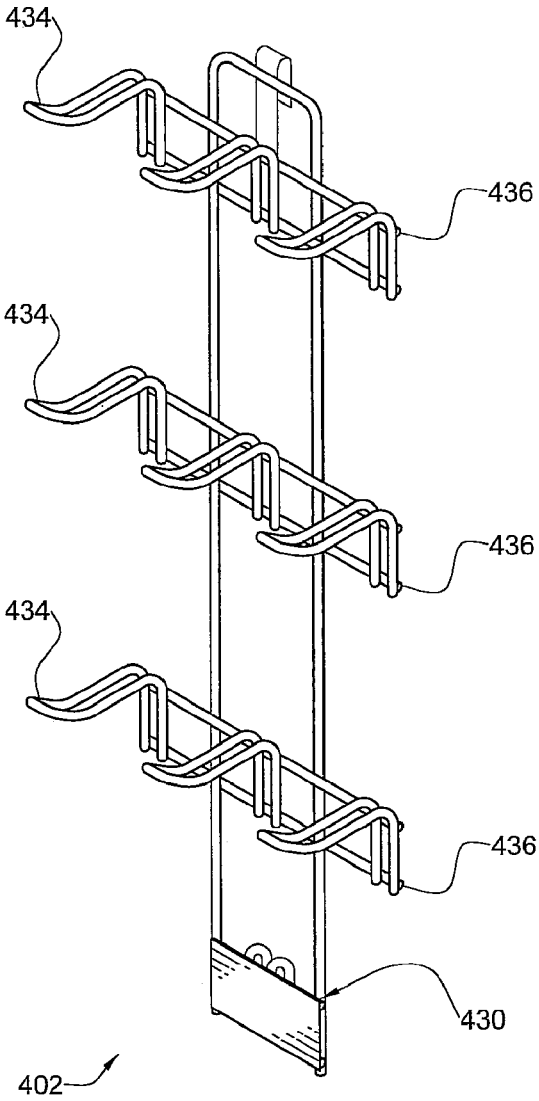
FIG. 47 is a perspective view of a vertical safety peg display of the retail display system according to a preferred embodiment of the present invention.

FIG. 47 is a perspective view of a vertical safety peg display 430 of the retail display system 30 according to a preferred embodiment of the present invention.

Figure 48:
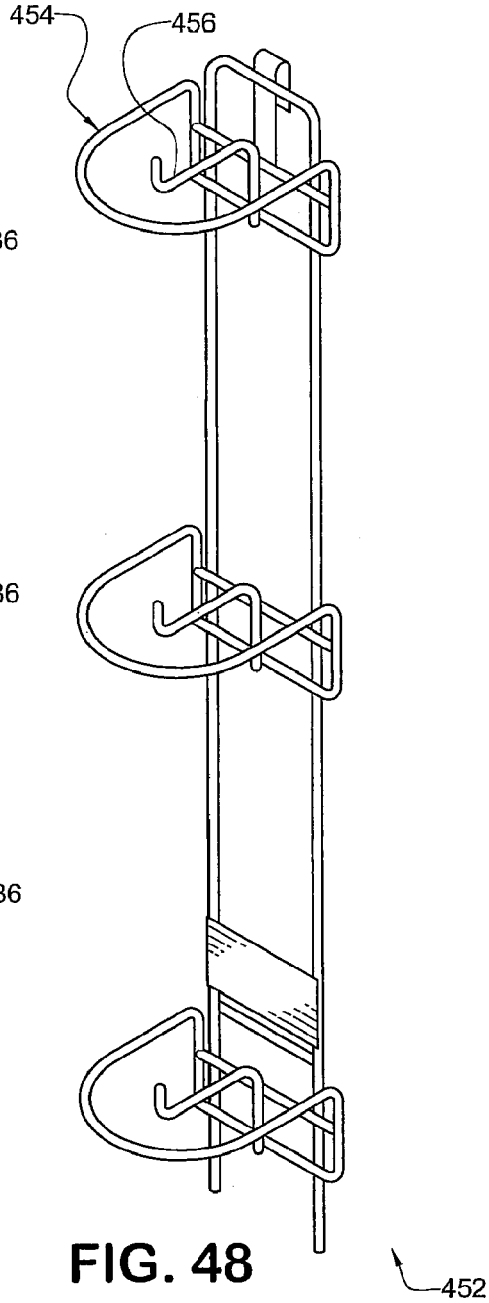
FIG. 48 is a perspective view of a vertical strip display comprising a safety ring of the retail display system according to a preferred embodiment of the present invention.

FIG. 48 is a perspective view of a vertical strip display 452 comprising a safety ring 454 of the retail display system 30 according to a preferred embodiment of the present invention. FIG. 48 illustrates a preferred embodiment of a safety ring 454. Preferably, safety ring 454 comprises a semi-circular shape, as shown. Preferably, safety ring 454 further comprises a standard peg 456, as shown, or under appropriate circumstances, another safety peg, such as safety peg 414, may suffice in lieu of standard peg 456. Preferably, the safety ring 454 provides protection from customer injury with use of a standard peg 456, allowing for merchandise packaging that is only orientated for a single standard peg (for example, having a round peg hole in the packaging rather than a slot for a safety peg 414). Under appropriate circumstances, other arrangements may suffice.

Figure 49:
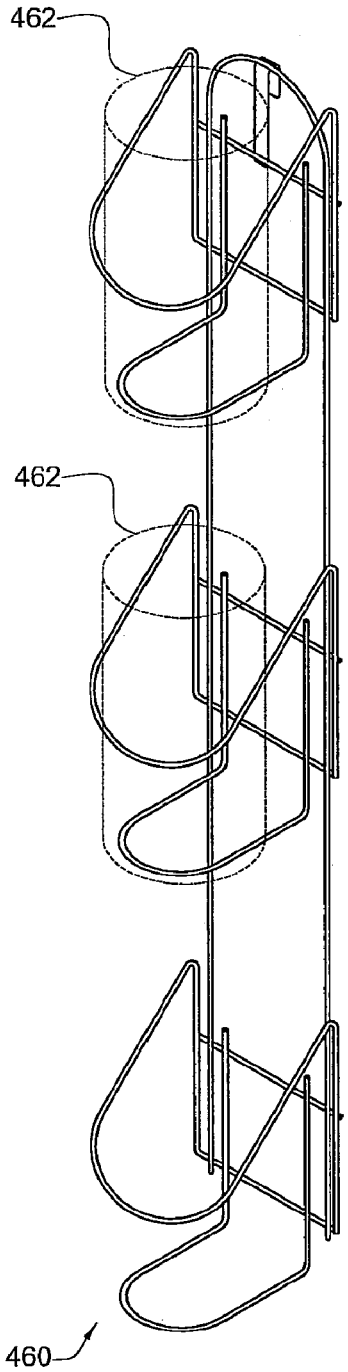
FIG. 49 is a perspective view of yet another vertical strip display of the retail display system according to a preferred embodiment of the present invention.

FIG. 49 is a perspective view of yet another vertical strip display 460 of the retail display system 30 according to a preferred embodiment of the present invention. Preferably, vertical strip display 460 is an example of a vertical strip display that may be used to merchandise cylindrical containers 462, preferably including containers adapted to hold foodstuffs. Under appropriate circumstances, other container arrangements may suffice. It is noted that the merchandising of product in a limited space and with a specific target inventory is intended to be embodied herein by these examples of custom-designed and built vertical strip displays 402 (even if manufactured in quantity). This arrangement embodying herein a vertical strip display 402 shaped and arranged for holding a specified kind of product and further shaped and arranged for holding a specified quantity of specified kind of product. Thus, in accordance with preferred embodiments of the present invention, there is provided, a method related to display of merchandise, comprising the steps of: providing at least one support plate comprising at least one front face, at least one rear face with at least one attacher, at least one aperture; and providing at least one merchandise display hanger comprising at least one hook structured and arranged to removably engage such at least one aperture; at least one merchandise support member structured and arranged to support merchandise; supporting such at least one hook from such at least one support plate by engagement of such at least one hook within such at least one aperture; positioning such at least one support plate adjacent to at least one surface; and attaching such at least one support plate adjacent to such at least one surface to prevent disengagement of such at least one hook from such at least one aperture by the proximal adjacency of such at least one support plate and such at least one hook to the at least one surface. Furthermore, it provides the step of providing a plurality of such at least one merchandise support members wherein each such plurality of such at least one merchandise support members are adapted to hold at least one specified kind of supplementary merchandise; and wherein each of such plurality of such at least one merchandise support members are further adapted to hold at least one specified quantity of such specified kind of supplementary merchandise.

Figure 50:
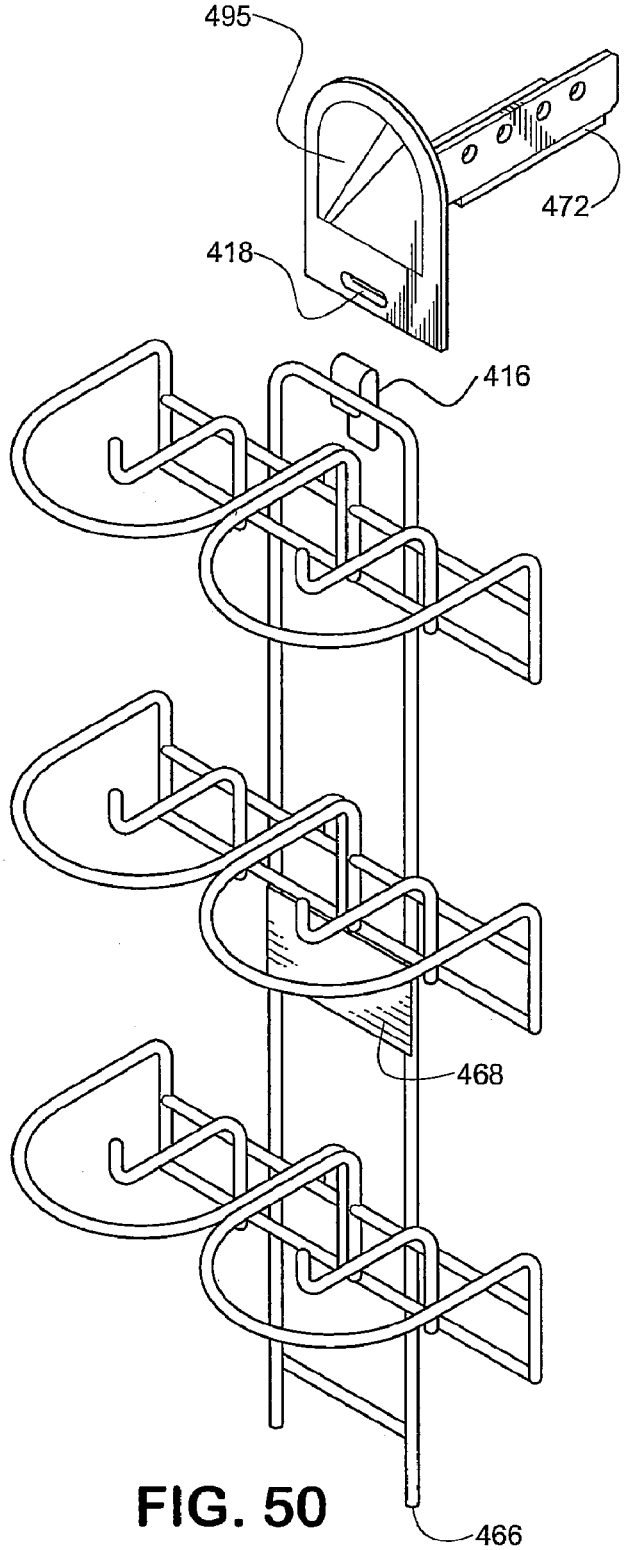
FIG. 50 is a perspective view of a vertical safety peg display and specialty hanger of the retail display system according to a preferred embodiment of the present invention.
Figure 51:
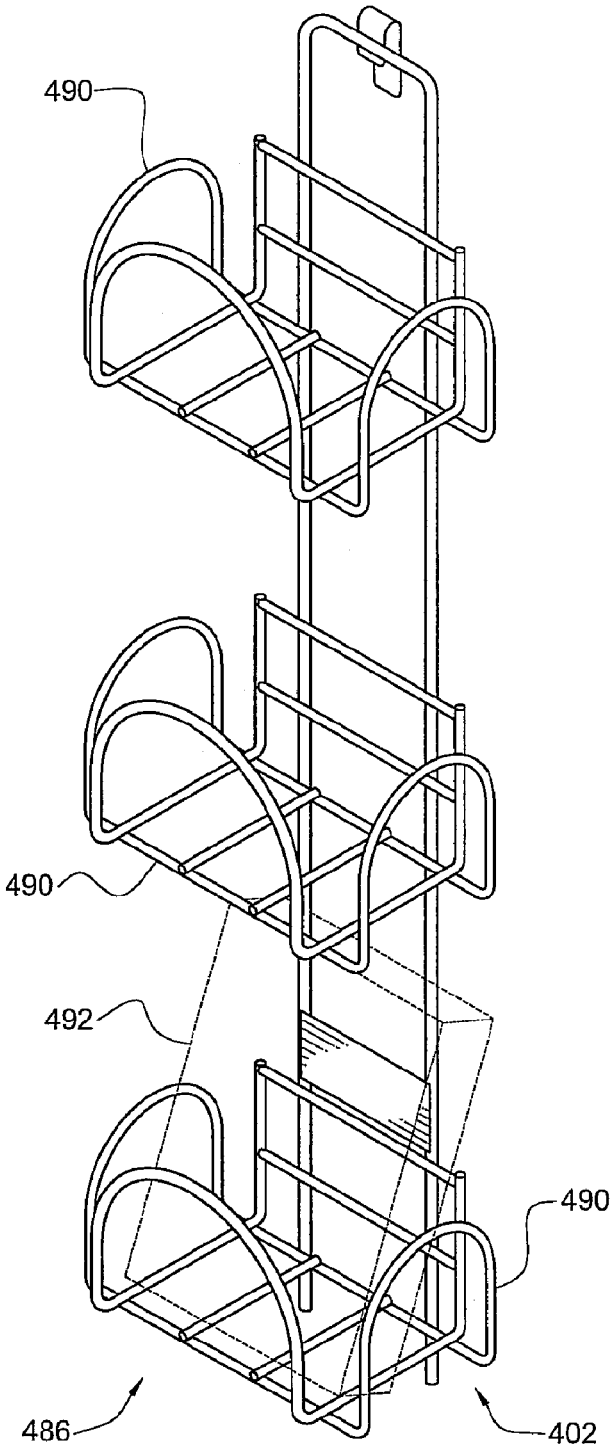
FIG. 51 is a perspective view of another vertical safety peg display of the retail display system according to a preferred embodiment of the present invention.

FIG. 50 is a perspective view of a vertical safety peg display 466 and specialty hanger 472 of the retail display system 30 according to a preferred embodiment of the present invention. Preferably, the retail display system 30 comprises a specialty hanger 472. Preferably, specialty hanger 472 may be used to adapt any of the vertical strip displays 402 to a side 474 of a horizontal shelf 476. Preferably, as illustrated in FIG. 50, the faceplate aperture 418 is preferably formed as shown, such that it comprises a slot formed to fit the integral flat hook 416, as shown. Under appropriate circumstances, other arrangements may suffice. FIG. 51 is a perspective view of another vertical safety peg display 486 of the retail display system 30 according to a preferred embodiment of the present invention. FIG. 51 illustrates a rack-type arrangement of small support shelves 490 for use, for example, with books 492 (at least embodying herein wherein such at least one merchandise display hanger comprises a plurality of merchandise display holders; wherein at least one of such plurality of merchandise display holders comprises, at least one holder bottom support structured and arranged to support merchandise, at least one holder side rail). Those skilled in the art will now appreciate the versatility and adaptability of such rack-like embodiments with the retail display system 30.

Figure 52:
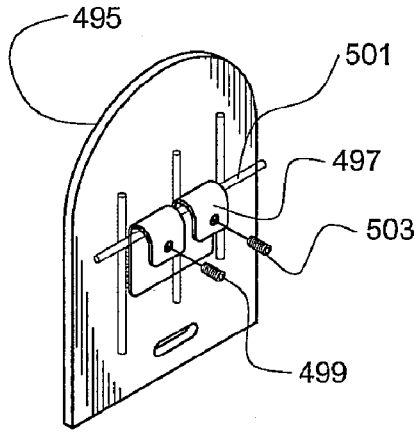
FIG. 52 is a perspective rear view of a faceplate and installation method for use on the retail display system according to a preferred embodiment of the present invention.

FIG. 52 is a perspective rear view of a faceplate 495 and installation method for use on the retail display system 30, according to another preferred embodiment of the present invention. Preferably, the faceplate 495 may be directly attached to grid 501 using bracket 497. Under appropriate circumstances, other arrangements may suffice. Preferably, bracket 497 is tightened to the grid using tightening screws 499 and 503, as shown. Under appropriate circumstances, other arrangements may suffice.

Figure 53:
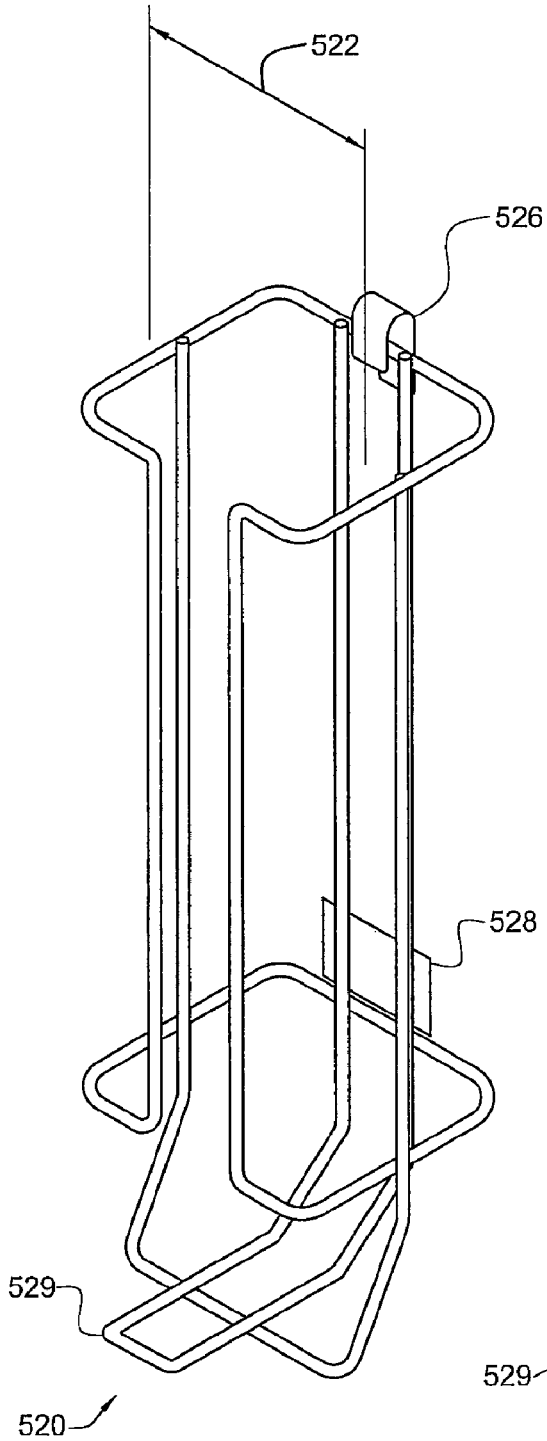
FIG. 53 is a perspective view of a dispensing rack, for dispensing hockey puck-sized objects, of the retail display system according to a preferred embodiment of the present invention.

FIG. 53 is a perspective view of a dispenser rack 520, for dispensing hockey puck-sized objects, of the retail display system 30, according to another preferred embodiment of the present invention. Preferably, dispenser rack 520 (at least embodying herein wherein such at least one merchandise display hanger comprises at least one merchandise display rack.) is mounted using brackets 526 and 528. Preferably, width 522 is about the diameter of a hockey puck-sized product. Preferably, width 522 is about the diameter of a chewing tobacco container. Preferably, grid wire 422 is the same gauge as any other above mentioned grid wires.

Figure 54:
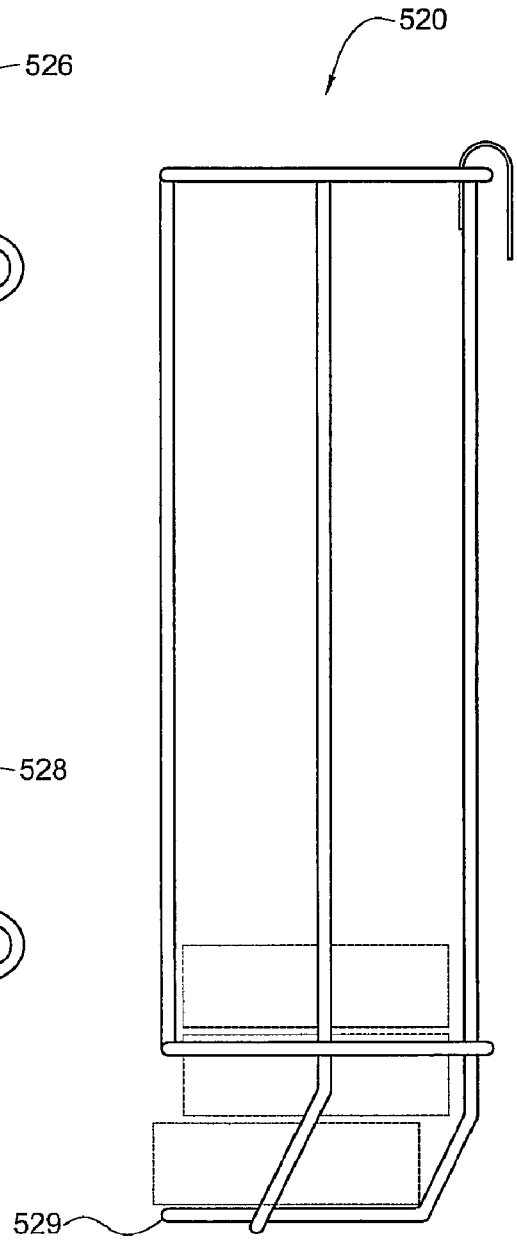
FIG. 54 is a side view of the FIG. 23 dispensing rack, for dispensing hockey puck-sized objects of the retail display system according to a preferred embodiment of the present invention.

FIG. 54 is a side view of the FIG. 53 dispenser rack 520, for dispensing "hockey-puck" sized objects, of the retail display system 30, according to another preferred embodiment of the present invention. Preferably, grid wire 422 is angled such that bottom 529 protrudes out to assist in the dispensing of hockey puck-sized objects.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A merchandise display system comprising:

a) at least one support plate comprising
   i) at least one front face,
   ii) at least one rear face having a first plane, and
   iii) at least one aperture,
   iv) wherein said at least one rear face comprises at least one attacher;

b) at least one merchandise display hanger comprising
   i) at least one hook structured and arranged to removably engage said at least one aperture;
   ii) at least one merchandise support member structured and arranged to support merchandise;
   iii) wherein said at least one hook comprises at least one first substantially linear segment comprising at least one first segment length, and at least one second substantially linear segment comprising at least one second segment length, wherein said at least one first substantially linear segment and said at least one second substantially linear segment are connected by at least one bend so that said at least one first substantially linear segment and said at least one second substantially linear segment are substantially parallel and offset from each other;

c) wherein said at least one hook and said at least one aperture are structured and arranged so that said at least one merchandise display hanger can be removably attached to said at least one support plate by inserting said at least one hook into said at least one aperture;

d) wherein said at least one hook and said at least one aperture are structured and arranged so that said at least one hook can be removably inserted into said at least one aperture when said at least one first substantially linear segment of said at least one merchandise display hanger and said first plane of said at least one rear face of said at least one support plate are in a first relative angular position;

e) wherein said at least one hook and said at least one aperture are structured and arranged so that said at least one hook cannot be removed from said at least one aperture when said at least one first substantially linear segment of said at least one merchandise display hanger and said first plane of said at least one rear face of said at least one support plate are rotated into in a second relative angular position.

2. The merchandise display system according to claim 1 wherein said at least one attacher, said at least one hook, and said at least one aperture are structured and arranged so that attaching said at least one attacher to at least one store fixture prevents removal of said at least one hook from said at least one aperture.

3. The merchandise display system according to claim 1 wherein said at least one attacher, said at least one hook, and said at least one aperture are structured and arranged so that attaching said at least one attacher to at least one store fixture restricts the relative angular position of said at least one merchandise display hanger and said at least one support plate so that said at least one hook cannot be removed from said at least one aperture.

4. The merchandise display system according to claim 1 wherein said at least at least one support plate and said at least one merchandise display hanger are structured and arranged so that attaching said at least one support plate adjacent at least one substantially flat surface restricts rotation of said at least one hook so that said at least one hook cannot be removed from said at least one aperture.

5. The merchandise display system according to claim 1 wherein said at least one front face is structured and arranged to display merchandising indicia.

6. The merchandise display system according to claim 1 wherein said at least one attacher comprises at least one clamp.

7. The merchandise display system according to claim 1 wherein said at least one attacher comprises at least one set screw.

8. The merchandise display system according to claim 1 wherein said at least one merchandise display hanger comprises at least one merchandise display rack.

9. The merchandise display system according to claim 1 wherein said at least one merchandise display hanger comprises a plurality of merchandise display pegs.

10. The merchandise display system according to claim 1 wherein a) said at least one merchandise display hanger comprises a plurality of merchandise display holders;

b) wherein at least one of said plurality of merchandise display holders comprises, i) at least one holder bottom support structured and arranged to support merchandise, and ii) at least one holder side rail.

11. The retail display system according to claim 1 wherein said at least one merchandise display hanger comprises at least one vertical wire grid.

12. The system according to claim 1 a) wherein said at least one attacher, said at least one hook, and said at least one aperture are structured and arranged so that attaching said at least one attacher to at least one store fixture restricts the relative angular position of said at least one merchandise display hanger and said at least one support plate so that said at least one hook cannot be removed from said at least one aperture;

b) wherein said at least one front face is structured and arranged to display merchandising indicia;

c) wherein said at least one attacher comprises at least one set screw;

d) wherein said at least one merchandise display hanger comprises a plurality of merchandise display holders;

e) wherein at least one of said plurality of merchandise display holders comprises, i) at least one holder bottom support structured and arranged to support merchandise, and ii) at least one holder side rail;

f) wherein said at least one hook comprises at least one substantially unshaped bend.

13. The system according to claim 1 wherein said aperture comprises at least one elongated slot.

14. The system according to claim 13 wherein said at least one hook further comprises a) at least one bar, comprising i) at least one width, and ii) at least one thickness;

iii) wherein said at least one width is substantially greater than said at least one thickness.

15. The system according to claim 14 wherein said at least one hook and said at least one elongated slot are structured and arranged so that said at least one hook closely fits within said at least one elongated slot to restrict rotation of said at least one merchandise display hanger about at least one axis oriented substantially perpendicular to said at least one front face.

16. The merchandise display system according to claim 1 further comprising at least one electronic display.

17. The merchandise display system according to claim 1 further comprising at least one label.

18. The merchandise display system according to claim 17 wherein said at least one label comprises at least one electronic label.

19. The merchandise display system according to claim 1 further comprising at least one electronic label.

20. A method related to display of merchandise, comprising the steps of:

a) providing at least one support plate comprising i) at least one front face, ii) at least one rear face having a first plane, and iii) at least one aperture, iv) wherein said at least one rear face comprises at least one attacher;

b) providing at least one merchandise display hanger comprising i) at least one hook structured and arranged to removably engage such at least one aperture, and ii) at least one merchandise support member structured and arranged to support merchandise, iii) wherein said at least one hook comprises at least one first substantially linear segment comprising at least one first segment length, and at least one second substantially linear segment comprising at least one second segment length, wherein said at least one first substantially linear segment and said at least one second substantially linear segment are connected by at least one bend so that said at least one first substantially linear segment and said at least one second substantially linear segment are substantially parallel and offset from each other;

c) wherein i) said at least one hook and said at least one aperture are structured and arranged so that said at least one merchandise display hanger can be removably attached to said at least one support plate by inserting said at least one hook into said at least one aperture, ii) said at least one hook and said at least one aperture are structured and arranged so that said at least one hook can be removably inserted into said at least one aperture when said at least one first substantially linear segment of said at least one merchandise display hanger and said first plane of said at least one rear face of said at least one support plate are in a first relative angular position, and iii) said at least one hook and said at least one aperture are structured and arranged so that said at least one hook cannot be removed from said at least one aperture when said at least one first substantially linear segment of said at least one merchandise display hanger and said first plane of said at least one rear face of said at least one support plate are in a second relative angular position, d) supporting such at least one hook from such at least one support plate by engagement of such at least one hook within such at least one aperture;

e) positioning such at least one support plate adjacent to at least one surface; and f) attaching such at least one support plate adjacent to such at least one surface to prevent disengagement of such at least one hook from such at least one aperture by the proximal adjacency of such at least one support plate and such at least one hook to the at least one surface.

21. The method according to claim 20 further comprising the step of:

a) providing a plurality of such at least one merchandise support members wherein each such plurality of such at least one merchandise support members are adapted to hold at least one specified kind of supplementary merchandise; and b) wherein each of such plurality of such at least one merchandise support members are further adapted to hold at least one specified quantity of such specified kind of supplementary merchandise.

22. The method according to claim 20 further comprising the step of:

a) supporting a plurality of foodstuffs with said at least one merchandise display hanger.

* * * * *